US007425926B2

(12) United States Patent
Funatsu

(10) Patent No.: US 7,425,926 B2
(45) Date of Patent: Sep. 16, 2008

(54) HIGH FREQUENCY WAVE GLASS ANTENNA FOR AN AUTOMOBILE

(75) Inventor: Toshifumi Funatsu, Chita-gun (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 11/184,919

(22) Filed: Jul. 20, 2005

(65) Prior Publication Data

US 2006/0017632 A1 Jan. 26, 2006

(30) Foreign Application Priority Data

Jul. 21, 2004 (JP) ..... 2004-213103
Sep. 15, 2004 (JP) ..... 2004-268528

(51) Int. Cl.
*H01Q 1/32* (2006.01)

(52) U.S. Cl. ..... 343/713

(58) Field of Classification Search ..... 343/712–713, 343/714, 711, 704
See application file for complete search history.

(56) References Cited

U.S. PATENT DOCUMENTS 4,063,247 A * 12/1977 Sakurai et al. ..... 343/704
5,029,308 A * 7/1991 Lindenmeier et al. ..... 343/704
5,132,161 A * 7/1992 Shibata et al. ..... 428/192
5,231,410 A * 7/1993 Murakami et al. ..... 343/713
5,307,076 A 4/1994 Murakami et al.
5,877,727 A * 3/1999 Saitou et al. ..... 343/713
6,028,557 A * 2/2000 Oka ..... 343/713
6,317,090 B1 * 11/2001 Nagy et al. ..... 343/713
6,452,557 B1 * 9/2002 Twort ..... 343/713
2007/0057848 A1 * 3/2007 Maniwa et al. ..... 343/700 MS

FOREIGN PATENT DOCUMENTS

| | | |
|---|---|---|
| JP | U-52-147151 | 4/1926 |
| JP | U-49-10442 | 5/1972 |
| JP | A-58-070641 | 4/1983 |
| JP | 61-30102 | 2/1986 |
| JP | U-62-201512 | 12/1987 |
| JP | U-4-132717 | 12/1992 |
| JP | U-5-43608 | 6/1993 |
| JP | A-6-314921 | 11/1994 |
| JP | 07-122918 | 5/1995 |
| JP | A-7-122918 | 5/1995 |
| JP | U-63-129307 | 8/1999 |
| JP | 2000-151249 | 5/2000 |
| JP | A-2000-151249 | 5/2000 |
| JP | A-2000-323914 | 11/2000 |

* cited by examiner

*Primary Examiner*—Huedung Mancuso
(74) *Attorney, Agent, or Firm*—Oblon, Spivak, McClelland, Maier & Neustadt, P.C.

(57) ABSTRACT

In a high frequency wave glass antenna for an automobile, wherein an antenna conductor and an antenna-conductor-side feeding electrode connected to the antenna conductor are provided to a laminated glass sheet for an automobile, the laminated glass sheet comprising two glass sheets bonded through a bonding layer, and wherein a receiver-side feeding electrode is disposed at a position to confront the antenna-conductor-side feeding electrode and on a car-interior-side surface of the laminated glass; each of the antenna-conductor-side feeding electrode and the receiver-side feeding electrode has an area of from 140 to 2,500 $mm^2$.

34 Claims, 15 Drawing Sheets

HIGH FREQUENCY WAVE GLASS ANTENNA FOR AN AUTOMOBILE

BACKGROUND OF THE INVENTION

1. Field of the Invention

The present invention relates to a high frequency wave glass antenna for an automobile, which is suitable for receiving digital terrestrial television broadcasting (from 473 to 767 MHz).

2. Discussion of Background

A laminated glass sheet for an automobile is configured by bonding two glass sheets through an interlayer film comprising of a synthetic resin. There has been disclosed a high frequency wave glass antenna for an automobile, wherein an antenna conductor is disposed on a bonding surface on an inner side of such a laminated glass sheet, and a receiver-side feeding electrode is disposed at a position to confront an antenna-conductor-side feeding electrode and on an interior-side surface of the laminated glass sheet (see, e.g., FIG. 6 in JP-A-61-30102).

However, this patent document is silent about the dimensions of the antenna-conductor-side feeding electrode and the dimensions of the receiver-side feeding electrode. There is a problem from the viewpoint of how to apply this prior art to digital television broadcasting or UHF television broadcasting.

SUMMARY OF THE INVENTION

It is an object of the present invention to provide a high frequency wave glass antenna for an automobile, which is capable of solving the problem of the prior art stated earlier.

The present invention provides a high frequency wave glass antenna for an automobile, comprising two glass sheets, the glass sheets being bonded through a bonding layer to form a laminated glass sheet for an automobile; an antenna conductor; an antenna-conductor-side feeding electrode connected to the antenna conductor; the antenna conductor and the antenna-conductor-side feeding electrode being disposed between the two glass sheets; and a receiver-side feeding electrode disposed at a position to confront the antenna-conductor-side feeding electrode and on a car-interior-side surface of the laminated glass; wherein each of the antenna-conductor-side feeding electrode and the receiver-side feeding electrode has an area of from 49 to 2,500 $mm^2$.

The present invention also provides a high frequency wave glass antenna for an automobile, comprising two glass sheets, the glass sheets being bonded through a bonding layer to form a laminated glass sheet for an automobile; an antenna conductor; an antenna-conductor-side feeding electrode connected to the antenna conductor; the antenna conductor and the antenna-conductor-side feeding electrode being disposed between the two glass sheets; and a receiver-side feeding electrode disposed at a position to confront the antenna-conductor-side feeding electrode and on a car-interior-side surface of the laminated glass; wherein a shortest distance between the receiver-side feeding electrode and an edge of an opening formed in a car body is from 1.8 to 50.0 mm.

The present invention also provides a high frequency wave glass antenna for an automobile, comprising two glass sheets, the glass sheets being bonded through a bonding layer to form a laminated glass sheet for an automobile; a first antenna conductor; a first antenna-conductor-side feeding electrode connected to the first antenna conductor; the first antenna conductor and the first antenna-conductor-side feeding electrode being disposed between the two glass sheets; a second antenna conductor; a second antenna-conductor-side feeding electrode connected to the second antenna conductor; the second antenna conductor and the second antenna-conductor-side feeding electrode being disposed between the two glass sheets; a first receiver-side feeding electrode disposed at a position to confront the first antenna-conductor-side feeding electrode and on a car-interior-side surface of the laminated glass; and a second receiver-side feeding electrode disposed at a position to confront the second antenna-conductor-side feeding electrode and on the car-interior-side surface of the laminated glass; wherein a distance between the first antenna-conductor-side feeding electrode and the second antenna-conductor-side feeding electrode is from 6 to 100 mm.

The present invention also provides a high frequency wave glass antenna for an automobile, comprising two glass sheets, the glass sheets being bonded through a bonding layer to form a laminated glass sheet for an automobile; a first antenna conductor; a first antenna-conductor-side feeding electrode connected to the first antenna conductor; the first antenna conductor and the first antenna-conductor-side feeding electrode being disposed on a car-interior-side surface; a second antenna conductor; a second antenna-conductor-side feeding electrode connected to the second antenna conductor; the second antenna conductor and the second antenna-conductor-side feeding electrode being disposed between the two glass sheets; a receiver-side feeding electrode disposed at a position to confront the second antenna-conductor-side feeding electrode and on the car-interior-side surface of the laminated glass; wherein a distance between the first antenna-conductor-side feeding electrode and the receiver-side feeding electrode is from 2.5 to 100 mm.

In accordance with the present invention, it is possible to have a superior transmission efficiency of a received signal transmitted from the antenna-conductor-side feeding electrode to the receiver-side feeding electrode and to receive digital television broadcasting or UHF television broadcasting with good sensitivity and in a good way by adopting the arrangement stated earlier.

BRIEF DESCRIPTION OF THE DRAWINGS

A more complete appreciation of the invention and many of the attendant advantages thereof will be readily obtained as the same becomes better understood by reference to the following detailed description when considered in connection with the accompanied drawings, wherein.

DETAILED DESCRIPTION OF THE PREFERRED EMBODIMENTS

Figure 1:
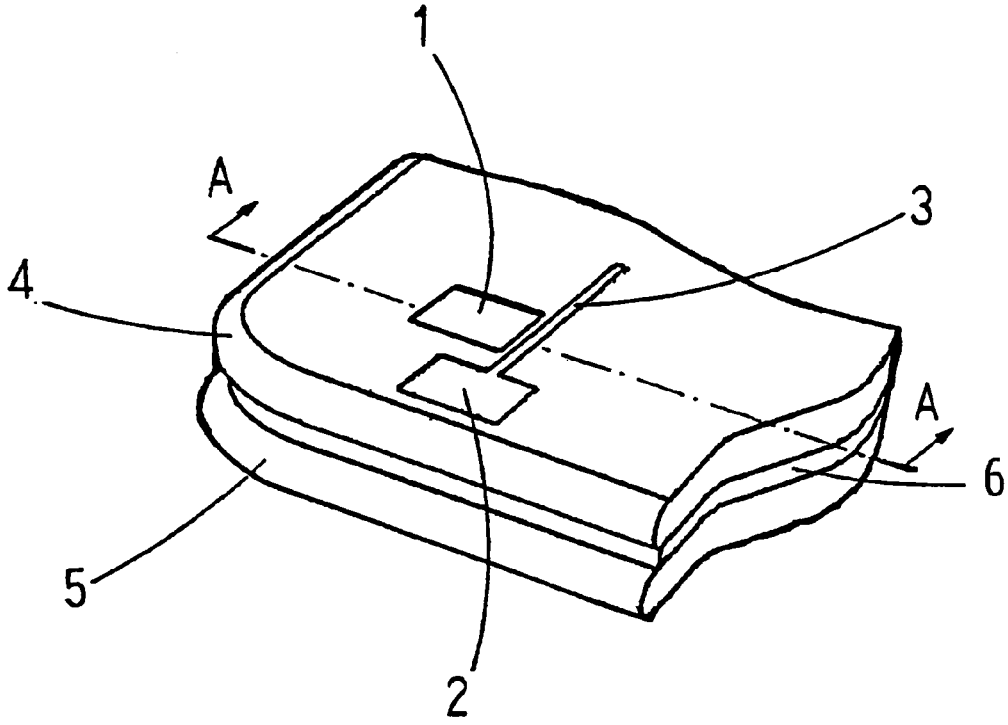
FIG. 1 is a perspective view of the high frequency wave glass antenna for an automobile, according to a first embodiment of the present invention.

Now, the high frequency wave glass antenna for an automobile, according to the present invention will be described in detail based on preferred embodiments shown in the accompanying drawings. FIG. 1 is a perspective view showing the high frequency wave glass antenna for an automobile, according to a first embodiment of the present invention, and FIGS. 2 and 3 are cross-sectional views of the high frequency wave glass antenna for an automobile, shown in FIG. 1, both figures showing different modes.

Figure 2:
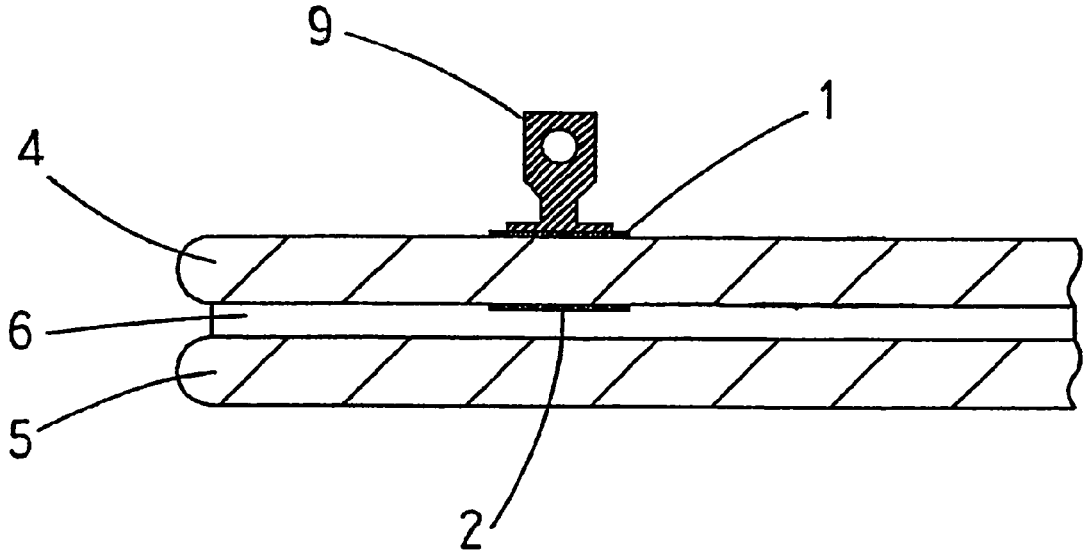
FIG. 2 is a cross-sectional view taken along line A-A of FIG. 1 in the first embodiment.
Figure 3:
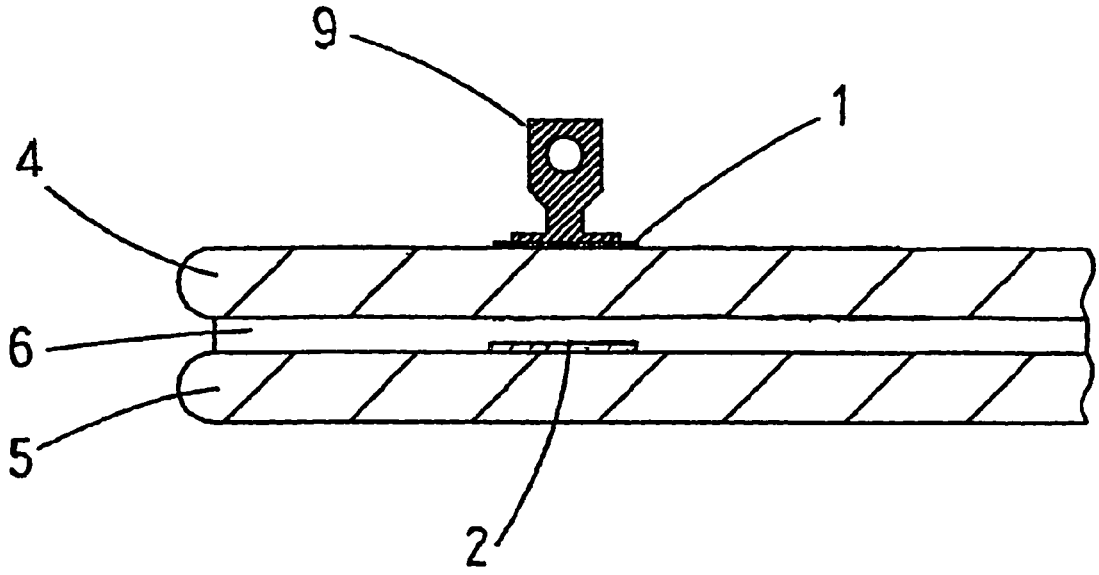
FIG. 3 is a cross-sectional view taken along line A-A of FIG. 1 in a modified mode.

In FIGS. 1, 2 and 3, reference numeral 1 designates a receiver-side feeding electrode (hereinbelow, referred to as the opposite electrode), reference numeral 2 designates an antenna-conductor-side feeding electrode, reference numeral 3 designates an antenna conductor, reference numeral 4 designates a car-interior-side glass sheet, reference numeral 5 designates a car-exterior-side glass sheet, and reference numeral 6 designates an interlayer film, which comprises a synthetic resin. In FIGS. 2 and 3, reference numeral 9 designates a metal terminal, which is disposed as required, and the metal terminal is omitted in FIG. 1. In each of FIGS. 1, 2 and 3, an upper portion is a car-interior side.

An example of the laminated glass sheet utilized in the present invention is an automobile laminated glass sheet, which is configured by bonding two glass sheets through the interlayer film 6 comprising of a synthetic resin. In the modes shown in FIGS. 1, 2 and 3, the car-interior-side glass sheet 4 and the car-exterior-side glass sheet 5 are bonded together by the interlayer film 6 interposed therebetween. For this reason, the interlayer film 6 has an adhesive property.

The antenna conductor 3 and the antenna-conductor-side feeding electrode 2 are disposed between the car-interior-side glass sheet 4 and the car-exterior-side glass sheet 5. In the mode shown in FIG. 2, the antenna conductor 3 and the antenna-conductor-side feeding electrode 2 are disposed on a boding surface of the car-interior-side glass sheet 4 on an inner side of the laminated glass sheet. In the mode shown in FIG. 3, the antenna conductor 3 and the antenna-conductor-side feeding electrode 2 are disposed on a boding surface of the car-exterior-side glass sheet 5 on the inner side of the laminated glass sheet. In other words, there is no limitation to the positions of the antenna conductor 3 and the antenna-conductor-side feeding electrode 2 as long as both elements are disposed between the car-interior-side glass sheet 4 and the car-exterior-side glass sheet 5. For example, the antenna conductor 3 and the antenna-conductor-side feeding electrode 2 may be disposed in the interlayer film 6. The positions of both elements may be determined so as to achieve the best antenna performance.

The opposite electrode 1 is disposed at a position to confront the antenna-conductor-side feeding electrode 2 and on a car-interior-side surface of the laminated glass sheet (on a car-interior-side surface of the car-interior-side glass sheet 4). By confronting the antenna-conductor-side feeding electrode 2 and the opposite electrode 1 as stated earlier, the antenna-conductor-side feeding electrode 2 and the opposite electrode 1 form at least one of electromagnetic coupling and capacitive coupling so that a received signal excited in the antenna conductor 3 is transmitted through the antenna-conductor-side feeding electrode 2 and the opposite electrode 1 in this order and is finally transmitted to a receiver side through a cable (not shown) connected to the opposite electrode 1. When a shielding layer is disposed on the car-interior-side surface of the laminated glass sheet, the opposite electrode 1 may be disposed on the shielding layer. The shielding layer may comprise, e.g., a ceramic material.

Each of the antenna-conductor-side feeding electrode 2 and the opposite electrode 1 has an area of from 49 to 2,500 $mm^2$. It is preferred from the viewpoint of improving the transmission efficiency that each of the antenna-conductor-side feeding electrode 2 and the opposite electrode 1 have an area of 49 $mm^2$ or above. It is also preferred that each of the antenna-conductor-side feeding electrode 2 and the opposite electrode 1 have an area of 2,500 $mm^2$ or below. This is because it is possible to improve the transmission efficiency and because it is possible to ensure a visual field and to have a good appearance since each of the antenna-conductor-side feeding electrode 2 and the opposite electrode 1 can be prevented from having too large an area. The area ranges of the antenna-conductor-side feeding electrode 2 and the opposite electrode 1, which are required to have such advantages, are listed in Table 1. The area range having a larger number can have a more improved advantage.

| Order of improved advantages | Area range of antenna-conductor-side feeding electrode 2 and area of opposite electrode ($mm^2$) |
|---|---|
| 1 | 49 to 2,500 |
| 2 | 92 to 2,500 |
| 3 | 140 to 2,500 |
| 4 | 230 to 2,500 |
| 5 | 260 to 1840 |
| 6 | 300 to 1600 |
| 7 | 360 to 900 |

It is preferred that the area of the antenna-conductor-side feeding electrode 2 be from 0.5 to 1.5 times that of the opposite electrode 1. When the area of the antenna-conductor-side feeding electrode and the area of the opposite electrode are in this range, the transmission efficiency and compactification can be improved in comparison with the other ranges. A more preferred range is from 0.7 to 1.3 times. A particularly preferred range is from 0.8 to 1.2 times. In the mode shown in FIG. 1, the area of the antenna-conductor-side feeding electrode 2 conforms to or substantially conforms to the area of the opposite electrode.

Figure 16:
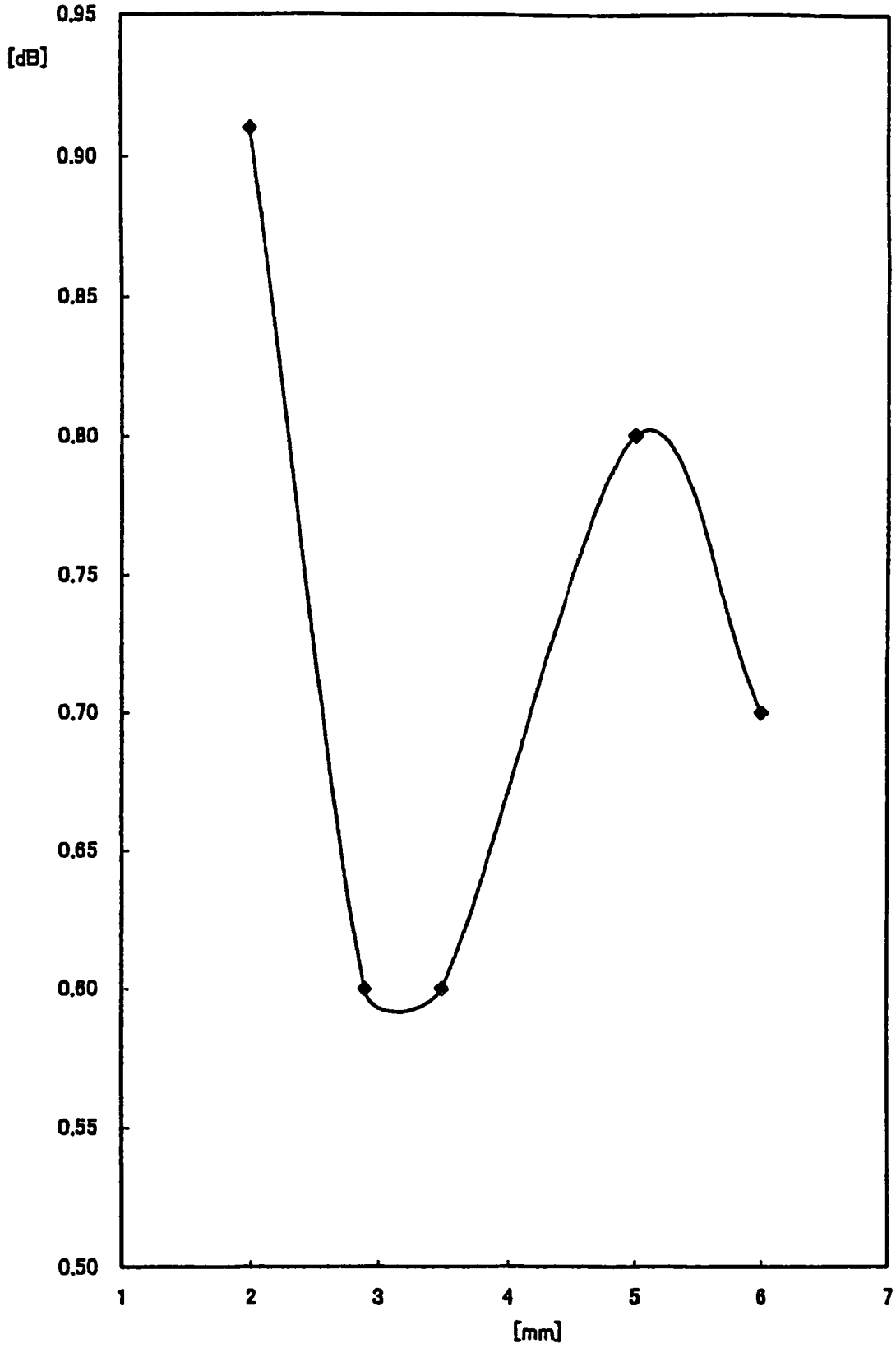
FIG. 16 is a characteristic view in Example 3, wherein the vertical axis represents a transmission efficiency and the horizontal axis represents the thickness of a glass sheet.

The distance between the antenna-conductor-side feeding electrode 2 and the receiver-side feeding electrode 1 is related to the transmission efficiency of a received signal transmitted from the antenna-conductor-side feeding electrode 2 to the receiver-side feeding electrode 1, such that this transmission efficiency changes, having a minimum value and a maximum value according to the distance. It is supposed that this phenomenon is caused by, e.g., multiple reflection occurring between both surfaces of the car-interior-side glass sheet 4. When the interlayer film 6 is interposed between the antenna-conductor-side feeding electrode 2 and the receiver-side feeding electrode 1, the interlayer film 6 also has an effect since, e.g., multiple reflection occurs between both surfaces of the interlayer film 6. This phenomenon is shown in FIG. 16 stated later.

It is preferred that this distance be set to prevent the transmission efficiency from being brought close to the minimum value. In the case shown in FIG. 16, the distance between the antenna-conductor-side feeding electrode 2 and the opposite electrode 1 is preferably from 1.50 to 2.72 mm or from 2.87 to 6.00 mm. When this distance is 1.50 mm or above, the laminated glass sheet can have a sufficient strength. When this distance is 2.72 mm or below, or 2.87 mm or above, the transmission efficiency can be improved. When this distance is 6.00 mm or below, the laminated glass sheet can be prevented from having too large a thickness, which is preferable.

From the viewpoint of improving the transmission efficiency, it is preferred that the distance between the antenna-conductor-side feeding electrode and the receiver-side feeding electrode be set so as to satisfy the formula of maximum value≧transmission efficiency≧(1/3) (2×maximum value+minimum value). In this formula, the transmission efficiency, the maximum value and the minimum value are values that are obtained by conversion to dB values. In the case shown in FIG. 16, this distance preferably ranges from 1.50 to 2.49 mm or from 4.36 to 6.00 mm. This distance particularly preferably ranges from 1.50 to 2.31 mm.

In the mode shown in FIG. 2, this distance mainly corresponds to the thickness of the car-interior-side glass sheet 4, which is interposed between the antenna-conductor-side feeding electrode 2 and the opposite electrode 1. Even when the interlayer film 6 is interposed between the antenna-conductor-side feeding electrode 2 and the opposite electrode 1 as in the mode shown in FIG. 3, the preferred ranges of the distance stated earlier are applicable. This is because the effect given by interposition of the interlayer film 6 is too small to be omitted in approximate calculation for determination of this distance range since the thickness of the interlayer film 6 is normally smaller than that of the car-interior-side glass sheet 4 and since the relative dielectric constant of the interlayer film 6 (normally from 3.0 to 4.0) is normally smaller than the relative dielectric constant of the car-interior-side glass sheet 4 (normally from 6.0 to 7.0). The thickness of the interlayer film 6 preferably ranges from 0.3 to 1.2 mm, particularly from 0.5 to 0.8 mm.

When the thickness of the car-interior-side glass sheet 4 increases, the transmission efficiency decrease, increases and decreases as shown in FIG. 16. In other words, the transmission efficiency changes, having a minimum value and a maximum value according to the thickness of the car-interior-side glass sheet 4.

In the present invention, it is preferred that the distance between the opposite electrode 1 and the edge of an opening formed in the car body be from 1.8 to 50.0 mm. It is preferred from the viewpoint of improving the transmission efficiency that this distance be 1.8 mm or above. It is preferred from the viewpoint of ensuring a visual field and having a good appearance that this distance be 50.0 mm or below. This distance more preferably ranges from 3.1 to 30.0 mm, particularly from 5.0 to 20.0 mm.

It is preferred from the viewpoint of improving the transmission efficiency that the shortest distance between the opposite electrode 1 and the edge of the opening formed in the car body is from 1.8 to 28 mm when each of the area of the antenna-conductor-side feeding electrode 2 and the area of the opposite electrode 1 is from 49 to 144 $mm^2$, particularly from 49 to 92 $mm^2$. In this case, the shortest distance between the opposite electrode 1 and the edge of the opening formed in the car body more preferably ranges from 3.1 to 25.0 mm, particularly from 5.0 to 23.0 mm.

In the cases shown in FIGS. 1, 2 and 3, the number of each of the antenna conductor 3, the antenna-conductor-side feeding electrode 2 and the opposite electrode 1 is one. However, the number is not limited to one. A plurality of antenna conductor, a plurality of antenna-conductor-side feeding electrode and a plurality of opposite electrode may be disposed. For example, when a second antenna conductor and a second antenna-conductor-side feeding electrode are disposed on the laminated glass sheet so as to be close to each other in addition to the antenna conductor 3 (first antenna conductor), the antenna-conductor-side feeding electrode 2 (first antenna-conductor-side feeding electrode) and the opposite electrode 1 shown in FIGS. 1, 2 and 3, power may be fed from the antenna conductor 3 and the second antenna conductor, utilizing a potential difference between the antenna conductor 3 and the second antenna conductor. An opposite electrode for the second antenna-conductor-side feeding electrode may be disposed at a position on the laminated glass sheet.

Each of the opposite electrode 1 and the antenna-conductor-side feeding electrode 2 is formed in a square shape or a substantially square shape in FIG. 1. However, both elements are not limited to have such a shape. Both elements may be formed in a tetragonal shape or a substantially tetragonal shape except for a square shape, such as a rectangular shape or a substantially rectangular shape, or, e.g., a circular shape, a substantially circular shape, an oval shape, or a substantially oval shape. There is no limitation to the shape of the opposite electrode and the shape of the antenna-conductor-side feeding electrode.

Figure 4:
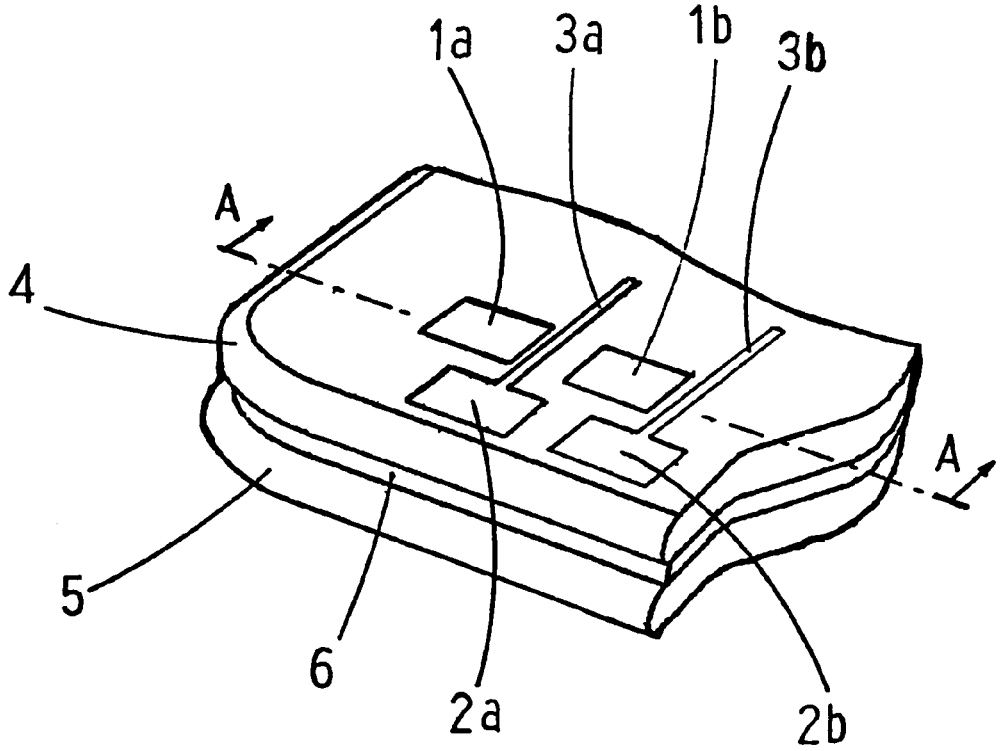
FIG. 4 is a perspective view of the high frequency wave glass antenna for an automobile, according to a second embodiment of the present invention.

Now, a second embodiment of the present invention will be described in detail in reference to relevant drawings. FIG. 4 is a perspective view of the high frequency wave glass antenna for an automobile, according to a second embodiment of the present invention, and FIGS. 5 and 6 are cross-sectional views taken along line A-A of FIG. 4 in the second embodiment, both figures showing different modes.

Figure 5:
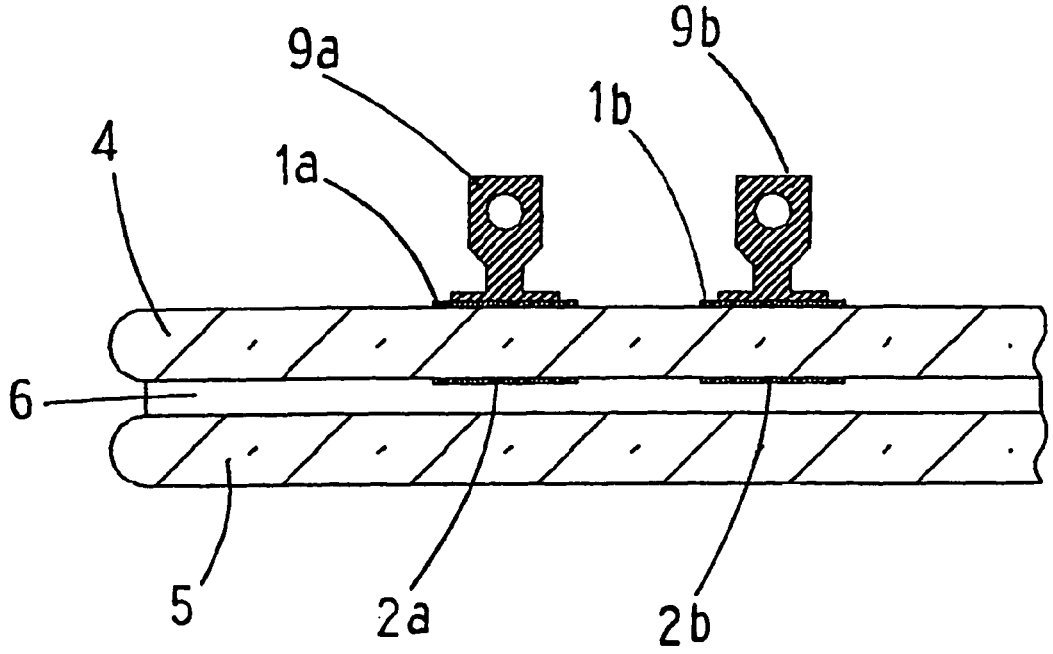
FIG. 5 is a cross-sectional view taken along line A-A of FIG. 4 in the second embodiment.
Figure 6:
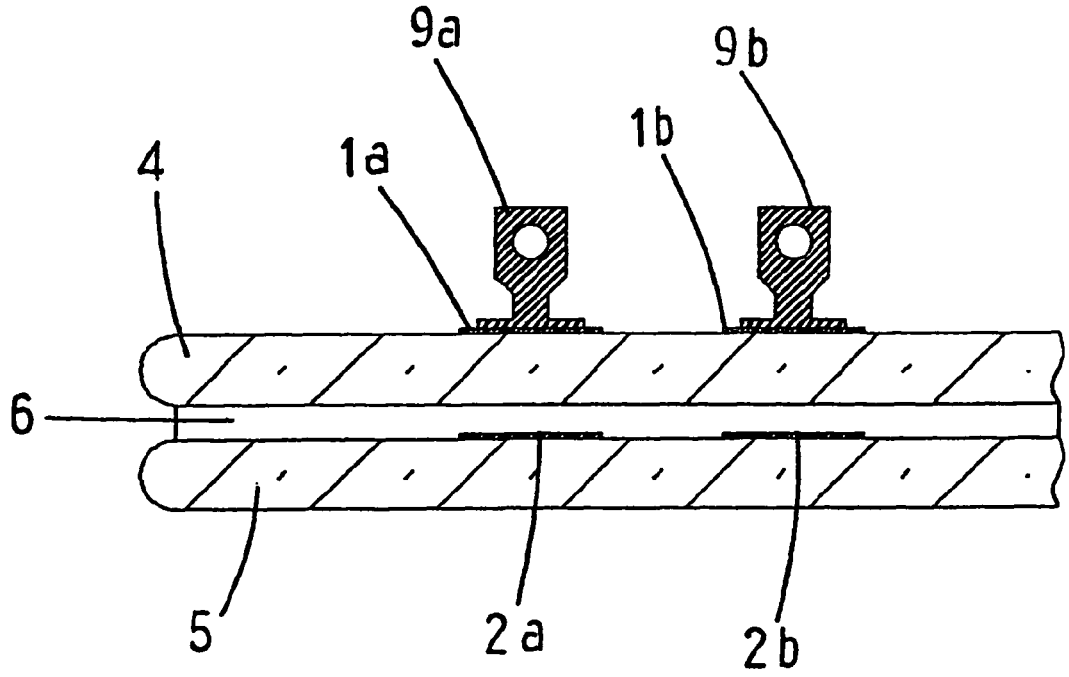
FIG. 6 is a cross-sectional view taken along line A-A of FIG. 4 in a modified mode.

In FIGS. 4, 5 and 6, reference numeral 1*a* designates a first receiver-side feeding electrode (hereinbelow, referred to as the first opposite electrode), reference numeral 1*b* designates a second receiver-side feeding electrode (hereinbelow, referred to as the second opposite electrode), reference numeral 2*a* designates a first antenna-conductor-side feeding electrode, reference numeral 2*b* designates a second antenna-conductor-side feeding electrode, reference numeral 3*a* designates a first antenna conductor, reference numeral 3*b* designates a second antenna conductor, and reference numeral 4 designates a car-interior-side glass sheet. In FIGS. 5 and 6, reference numerals 9*a* and 9*b* designate metal terminals, which are disposed as required, and the metal terminals are omitted in FIG. 4. In each of FIGS. 4, 5 and 6, an upper portion is a car-interior side.

In the second embodiment, the first antenna conductor 3*a*, the first antenna-conductor-side feeding electrode 2*a*, the second antenna conductor 3*b* and the second antenna-conductor-side feeding electrode 2*b* are disposed between the car-interior-side glass sheet 4 and the car-exterior-side glass sheet 5.

In the mode shown in FIG. 5, the first antenna conductor 3*a*, the first antenna-conductor-side feeding electrode 2*a*, the second antenna conductor 3*b* and the second antenna-conductor-side feeding electrode 2*b* are disposed on a bonding surface of the car-interior-side glass sheet 4 on an inner side of the laminated glass sheet.

In the mode shown in FIG. 6, the first antenna conductor 3*a*, the first antenna-conductor-side feeding electrode 2*a*, the second antenna conductor 3*b* and the second antenna-conductor-side feeding electrode 2*b* are disposed on a bonding surface of the car-exterior-side glass sheet 5 on the inner side of the laminated glass sheet. In other words, there is no limitation to the positions of the first antenna conductor 3*a*, the first antenna-conductor-side feeding electrode 2*a*, the second antenna conductor 3*b* and the second antenna-conductor-side feeding electrode 2*b* in the second embodiment as long as these elements are disposed between the car-interior-side glass sheet 4 and the car-exterior-side glass sheet 5. For example, the antenna conductors 3*a* and 3*b*, and the antenna-conductor-side feeding electrodes 2*a* and 2*b* may be disposed in the interlayer film 6. The positions of these elements may be determined so as to achieve the best antenna performance.

In summary, the first antenna conductor 3*a* and the first antenna-conductor-side feeding electrode 2*a* may be disposed on the bonding surface of the car-interior-side glass sheet 4 on the inner side of the laminated glass sheet or on the bonding surface of the car-exterior-side glass sheet 5 on the inner side of the laminated glass sheet. The second antenna conductor 3*b* and the second antenna-conductor-side feeding electrode 2*b* may be disposed on the bonding surface of the car-interior-side glass sheet 4 on the inner side of the laminated glass sheet or on the bonding surface of the car-exterior-side glass sheet 5 on the inner side of the laminated glass sheet.

In the second embodiment, the first opposite electrode 1*a* is disposed at a position to confront the first antenna-conductor-side feeding electrode 2*a* and on a car-interior-side surface of the laminated glass sheet (on a car-interior-side surface of the car-interior-side glass sheet 4), and the second opposite electrode 1*b* is disposed at a position to confront the second antenna-conductor-side feeding electrode 2*b* and on the car-interior-side surface of the laminated glass sheet.

By confronting the first antenna-conductor-side feeding electrode 2*a* and the first opposite electrode 1*a* as stated earlier, the first antenna-conductor-side feeding electrode 2*a* and the first opposite electrode 1*a* form at least one of electromagnetic coupling and capacitive coupling so that a received signal excited in the first antenna conductor 3*a* is transmitted through the first antenna-conductor-side feeding electrode 2*a* and the first opposite electrode 1*a* in this order and is finally transmitted to a receiver side through a cable (not shown) connected to the first opposite electrode 1*a*.

By confronting the second antenna-conductor-side feeding electrode 2*b* and the second opposite electrode 1*b*, the second antenna-conductor-side feeding electrode 2*b* and the second opposite electrode 1*b* form at least one of electromagnetic coupling and capacitive coupling so that a received signal excited in the second antenna conductor 3*b* is transmitted through the second antenna-conductor-side feeding electrode 2*b* and the second opposite electrode 1*b* in this order and is finally transmitted to the receiver side through a cable (not shown) connected to the second opposite electrode 1*b*. In other words, a potential difference between the first opposite electrode 1*a* and the second opposite electrode 1*b* is utilized as the received signal in the second embodiment.

When a shielding layer is disposed on the car-interior-side surface of the laminated glass sheet, the first opposite electrode 1*a* or the second opposite electrode 1*b* may be disposed on the shielding layer. The shielding layer may comprise, e.g., a ceramic material.

In the second embodiment, the distance between the first antenna-conductor-side feeding electrode 2*a* and the second antenna-conductor-side feeding electrode 2*b* (or, the distance between the closest portions of the first antenna-conductor-side feeding electrode 2*a* and the second antenna-conductor-side feeding electrode 2*b*) is from 6 to 100 mm. It is preferred from the viewpoint of improving the transmission efficiency that this distance be 6 mm or above. In the viewpoint of facilitating of mounting the cables connected to the first opposite electrode 1*a* and the second opposite electrode 1*b*, it is preferred that this distance be 100 mm or below. In particular, when coaxial cables are used as the cables, it is preferred from the viewpoint of easy mounting that this distance be 100 mm or below. This distance preferably ranges from 6 to 100 mm, more preferably from 8 to 100 mm, particularly preferably from 12 to 80 mm and most preferably from 20 to 50 mm.

When one of these conditions is met, it is preferred that the thickness of the car-interior-side glass sheet 4 or the sum of the thickness of the car-interior-side glass sheet 4 and the thickness of the interlayer film 6 be from 1.75 to 5.25 mm. A more preferred range is from 2.0 to 4.9 mm. It is preferred that the distance between the first antenna-conductor-side feeding electrode 2*a* and the second antenna-conductor-side feeding electrode 2*b* be equal to the distance between the first opposite electrode 1*a* and the second opposite electrode 1*b*.

In the second embodiment, when the distance between the first antenna-conductor-side feeding electrode 2*a* and the second antenna-conductor-side feeding electrode 2*b* is from 6 to 100 mm, it is preferred that each of the first antenna-conductor-side feeding electrode 2*a*, the second antenna-conductor-side feeding electrode 2*b*, the first opposite electrode 1*a* and the second opposite electrode 1*b* have an area of from 49 to 900 $mm^2$, particular an area of from 81 to 600 $mm^2$. When these elements have an area in these ranges, the second antenna-conductor-side feeding electrode 2*b*, the first opposite electrode 1*a* and the second opposite electrode 1*b* may have different areas.

Figure 7:
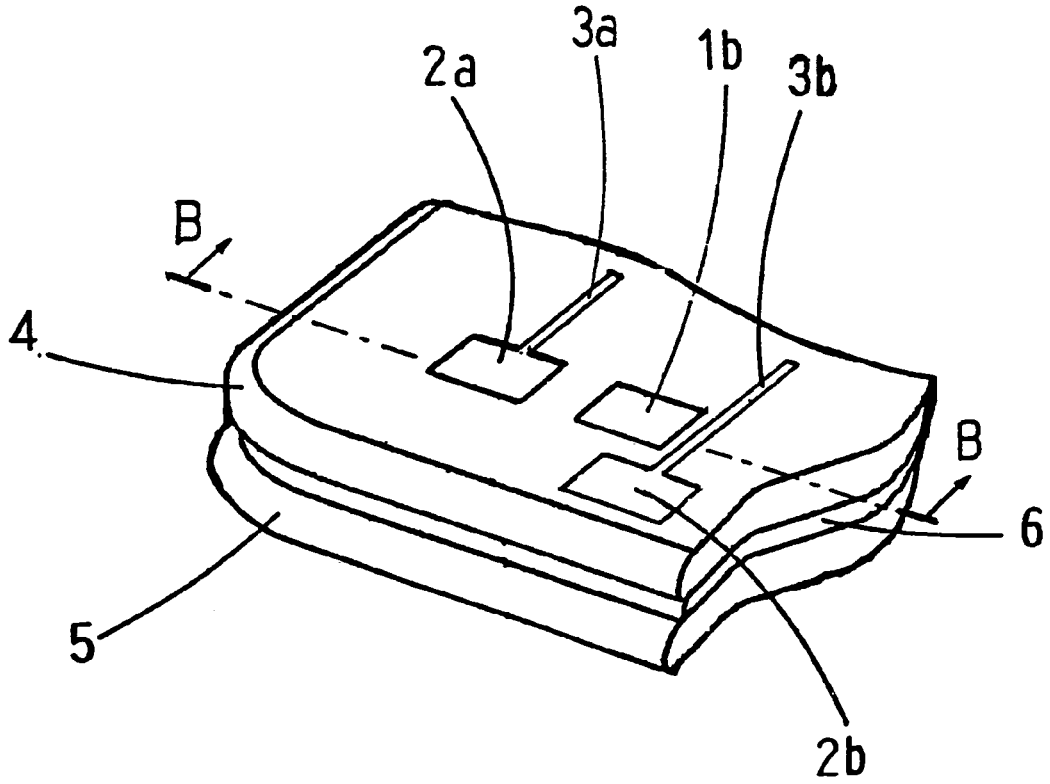
FIG. 7 is a perspective view of the high frequency wave glass antenna for an automobile, according to a third embodiment of the present invention.
Figure 8:
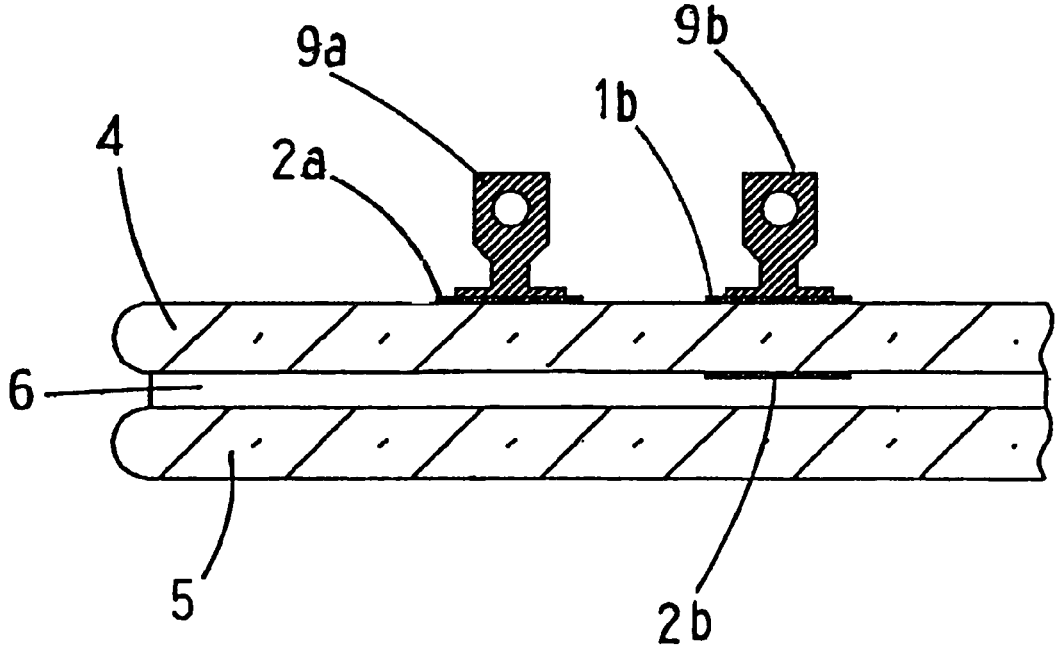
FIG. 8 is a cross-sectional view taken along line B-B of FIG. 7 in the third embodiment.

FIG. 7 is a perspective view of the high frequency wave glass antenna for an automobile, according to a third embodiment of the present invention, and FIG. 8 is a cross-sectional view taken along line B-B of FIG. 7 in the third embodiment shown in FIG. 7. In the third embodiment, a first antenna conductor 3*a* and a first antenna-conductor-side feeding electrode 2*a* are disposed on the car-interior-side surface of the laminated glass sheet.

The positions of a second antenna conductor 3*b*, a second antenna-conductor-side feeding electrode 2*b* and a receiver-side feeding electrode 1*b* (opposite electrode 1*b*) are the same as those in the first embodiment. By confronting the second antenna-conductor-side feeding electrode 2*b* and the opposite electrode 1*b*, the second antenna-conductor-side feeding electrode 2*b* and the opposite electrode 1*b* form at least one of electromagnetic coupling and capacitive coupling so that a received signal excited in the second antenna conductor 3*b* is transmitted through the second antenna-conductor-side feeding electrode 2*b* and the opposite electrode 1*b* in this order and is finally transmitted to a receiver side through a cable connected to the opposite electrode 1*b*. In other words, a potential difference between the first antenna-conductor-side feeding electrode 2*a* and the opposite electrode 1*b* is utilized as the received signal in the third embodiment.

In the third embodiment, the distance between the first antenna-conductor-side feeding electrode 2*a* and the opposite electrode 1*b* (or, the distance between the closest portions of the first antenna-conductor-side feeding electrode 2*a* and the opposite electrode 1*b*) is from 2.5 to 100 mm. It is preferred from the viewpoint of improving the transmission efficiency that this distance be 2.5 mm or above. In the viewpoint of facilitating of mounting the cable connected to the opposite electrode 1*b*, it is preferred that this distance be 100 mm or below. In particular, when a coaxial cable is used as the cable, it is preferred from the viewpoint of easy mounting that this distance be 100 mm or below.

This distance preferably ranges from 4 to 100 mm, more preferably from 6 to 100 mm, particularly preferably from 6 to 80 mm and most preferably from 6 to 50 mm. It is preferred from the viewpoint of improving the transmission efficiency that this distance is 10 mm or below, particularly 8 mm or below.

In the third embodiment, when this distance is set at a value from 2.5 to 10 mm, it is preferred that each of the first antenna-conductor-side feeding electrode 2*a*, the second antenna-conductor-side feeding electrode 2*b* and the opposite electrode 1*b* have an area of from 49 to 900 $mm^2$, particular an area of from 81 to 600 $mm^2$. When these elements have an area in these ranges, the first antenna-conductor-side feeding electrode 2*a*, the second antenna-conductor-side feeding electrode 2*b* and the opposite electrode 1*b* may have different areas. When one of these conditions is met, it is preferred that the thickness of the car-interior-side glass sheet 4 or the sum of the thickness of the car-interior-side glass sheet 4 and the thickness of the interlayer film 6 be from 1.75 to 5.25 mm. A more preferred range is from 2.0 to 4.9 mm.

When a shielding layer is disposed on the car-interior-side surface of the laminated glass sheet, at least one selected among the first antenna conductor 3*a*, the first antenna-conductor-side feeding electrode 2*a* and the opposite electrode 1*b* may be disposed on the shielding layer.

In the present invention, it is preferred that each of the first antenna-conductor-side feeding electrode 2*a*, the first opposite electrode 1*a*, the second antenna-conductor-side feeding electrode 2*b* and the second opposite electrode 1*b* have an area of from 140 to 2,500 $mm^2$. It is preferred from the viewpoint of improving the transmission efficiency that each of these electrodes have an area of 140 $mm^2$ or above. It is also preferred that each of these electrodes have an area of 2,500 $mm^2$ or below. This is because it is possible to improve the transmission efficiency and because it is possible to ensure a visual field and to have a good appearance since each of these electrodes can be prevented from having too large an area. The area of each of these electrodes preferably ranges from 230 to 2,500 $mm^2$, more preferably from 260 to 1,840 $mm^2$, particularly preferably from 300 to 1,600 $mm^2$ and most preferably from 360 to 900 $mm^2$.

In the present invention, it is preferred that each of the relative dielectric constant of the car-interior-side glass sheet 4 and the relative dielectric constant of the car-exterior-side glass sheet 5 preferably range from 6.0 to 7.5, more preferably from 6.5 to 7.0.

At least one selected among the first antenna-conductor-side feeding electrode 2*a*, the first opposite electrode 1*a*, the second antenna-conductor-side feeding electrode 2*b* and the second opposite electrode 1*b* may be formed in a tetragonal shape, a substantially tetragonal shape, a circular shape, a substantially circular shape, an oval shape or a substantially oval shape. There is no limitation to the shape of the electrodes.

In the present invention, examples of the material for each of the antenna conductors 3, 3*a* and 3*b*, the antenna-conductor-side feeding electrodes 2, 2*a* and 2*b*, and the opposite electrodes 1, 1*a* and 1*b* are copper foil, a copper strip and a copper wire. As another material, a silver paste may be printed on the bonding surface of the car-interior-side glass sheet 4 on the inner side of the laminated glass sheet or the bonding surface of the car-exterior side glass sheet 5 on the inner side of the laminated glass and be fired to form these elements for instance. When an antenna conductor and its relevant antenna-conductor-side feeding electrode are provided to the laminated glass sheet without being connected together, examples of how to connect the antenna conductor and the relevant antenna-conductor-side feeding electrode are soldering, welding, pressure welding, brazing and bonding by a conductive adhesive. An example of the material for the interlayer film 6 is polyvinyl butyral.

The present invention is also applicable to receive signals in a portion of the frequency band of digital terrestrial television broadcasting (from 470 to 704 MHz), UHF television broadcasting (from 450 to 750 MHz) and US digital television broadcasting (from 698 to 806 MHz).

EXAMPLE

Although the present invention will be described based on examples, it should be noted that the present invention is not limited to the examples, and that various improvements and modifications may of course be made without departing from the scope and sprit of the invention.

In the following examples, data were taken at 450 MHz, 500 MHz, 550 MHz, 600 MHz, 650 MHz, 700 MHz, 750 MHz and 800 MHz. The simple average of the transmission efficiency (dB value) at each of these frequencies is shown in the characteristic views, stated later. Now, the examples will be described in detail in reference to the accompanying drawings.

Example 1

Figure 9:
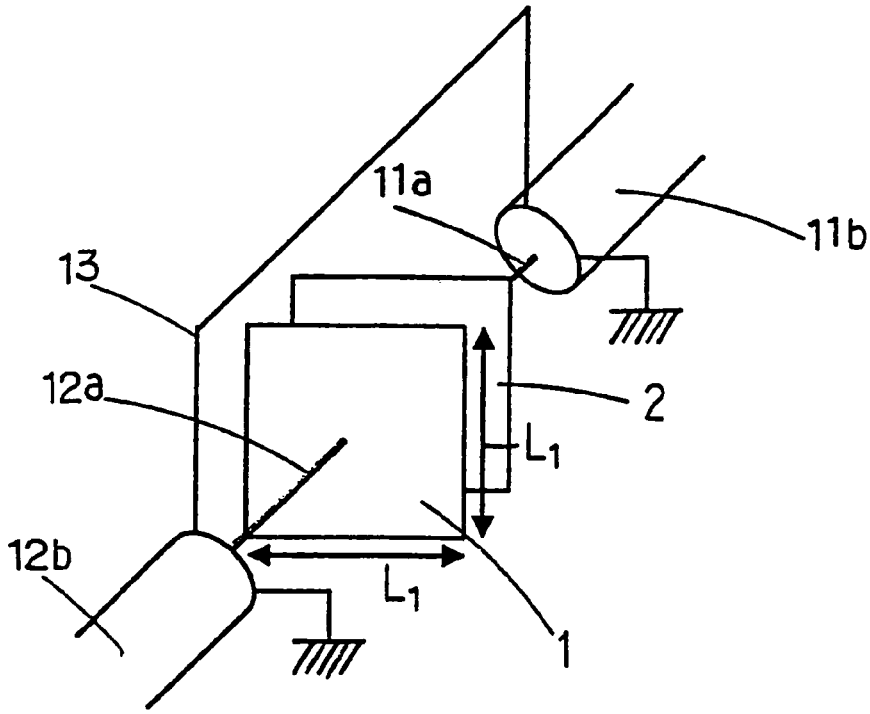
FIG. 9 is a structural view of a pseudo testing equipment of the high frequency wave glass antenna for an automobile, used in Example 1.

Pseudo testing equipment of the high frequency wave glass antenna for an automobile, as shown in FIG. 9, was prepared. Each of an antenna-conductor-side feeding electrode 2 and an opposite electrode 1 was prepared by affixing copper foil to a glass sheet (not shown) with a binder.

In FIG. 9, reference numeral 11*a* designates the inner conductor of a first coaxial cable, reference numeral 11*b* designates the outer conductor of the first coaxial cable, reference numeral 12*a* designates the inner conductor of a second coaxial cable, reference numeral 12*b* designates the outer conductor of the second coaxial cable, reference numeral 13 designates a lead wire connecting between the outer conductor 11*b* and the outer conductor 12*b*, and reference $L_1$ designates the length of one side of the antenna-conductor-side feeding electrode 2 and the length of one side of the opposite electrode 1. The glass sheet where the antenna-conductor-side feeding electrode 2 and the opposite electrode 1 were disposed is omitted from this figure. The specifications and the like of the copper foil, the glass sheet and the coaxial cable used in this example are shown below:

| | |
|---|---|
| Thickness of copper foil | 0.06 mm |
| Electrical resistivity of copper foil | $2.0 \times 10^{-6}$ Ωcm |
| Glass sheet (length × width × thickness) | 600 × 600 × 3.5 mm |
| Shortest distance between peripheral portion of glass sheet and copper foil | 10 mm |
| Impedance of coaxial cables | 50 Ω |

Bonding between the inner conductor 11*a* and the antenna-conductor-side feeding electrode 2, bonding between the inner conductor 12*a* and the opposite electrode 1, bonding between the outer conductor 11*b* and the lead wire 13, bonding between the outer conductor 12*b* and the lead wire 13, bonding between the outer conductor 11*b* and ground, and bonding between the outer conductor 12*b* and ground were made of soldering. A signal voltage having a voltage value was applied to the inner conductor 11*a*, and the signal voltage generated in the inner conductor 12*a* was measured. This measurement is applicable to the examples stated later.

Figure 14:
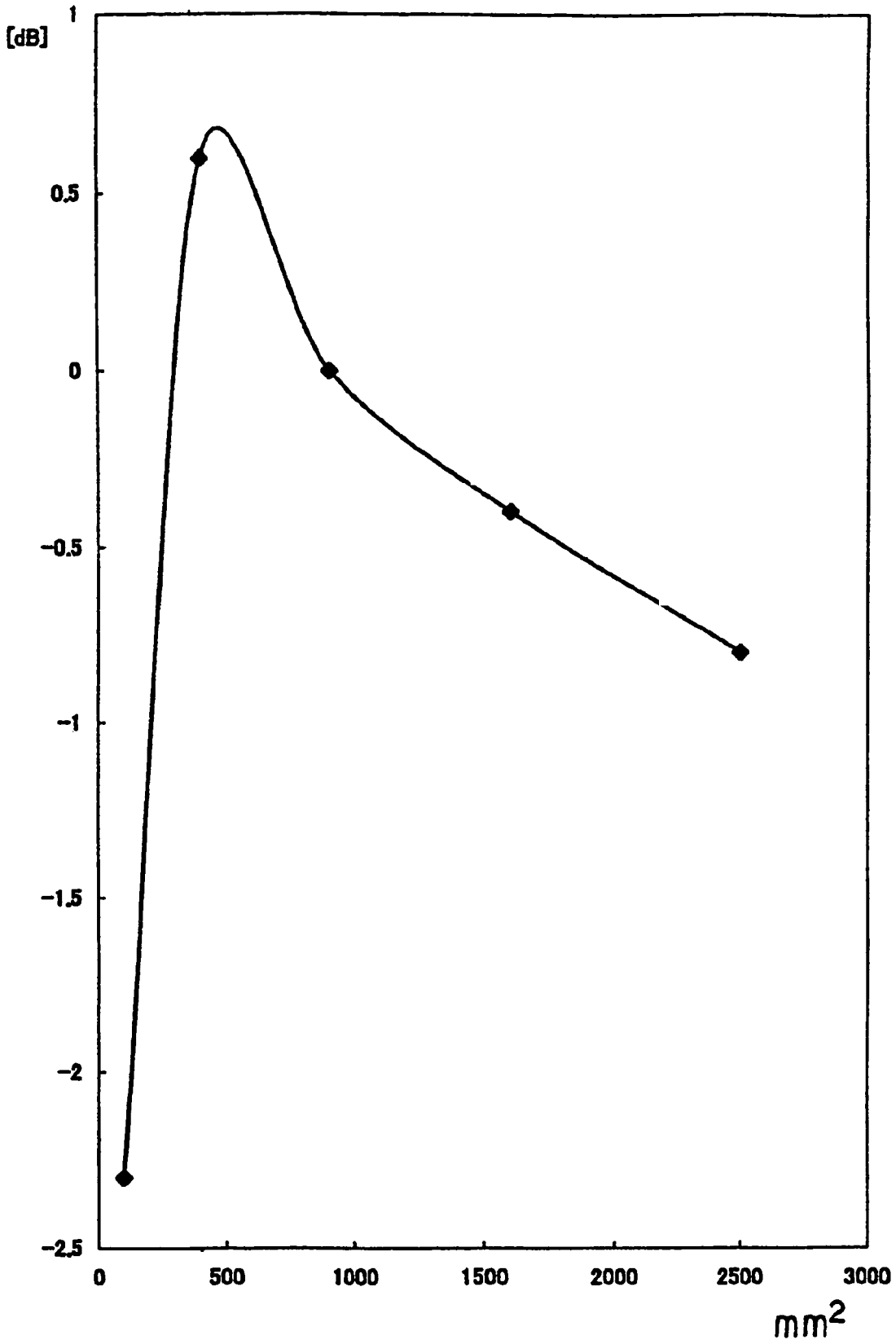
FIG. 14 is a characteristic view in Example 1, wherein the vertical axis represents a transmission efficiency and the horizontal axis represents the area of an antenna-conductor-side feeding electrode and the area of an opposite electrode.

The antenna-conductor-side feeding electrode 2 and the opposite electrode 1 were configured so as to have a square shape and the same dimensions as each other. In FIG. 14 is shown a characteristic diagram wherein the vertical axis represents a transmission efficiency (dB) and the horizontal axis represents the area of the antenna-conductor-side feeding electrode 2 and the area of the opposite electrode 1. Changes in the area of the antenna-conductor-side feeding electrode 2 and the area of the opposite electrode 1 were made by modifying $L_1$ in the range of from 10 to 50 mm.

Example 2

Figure 10:
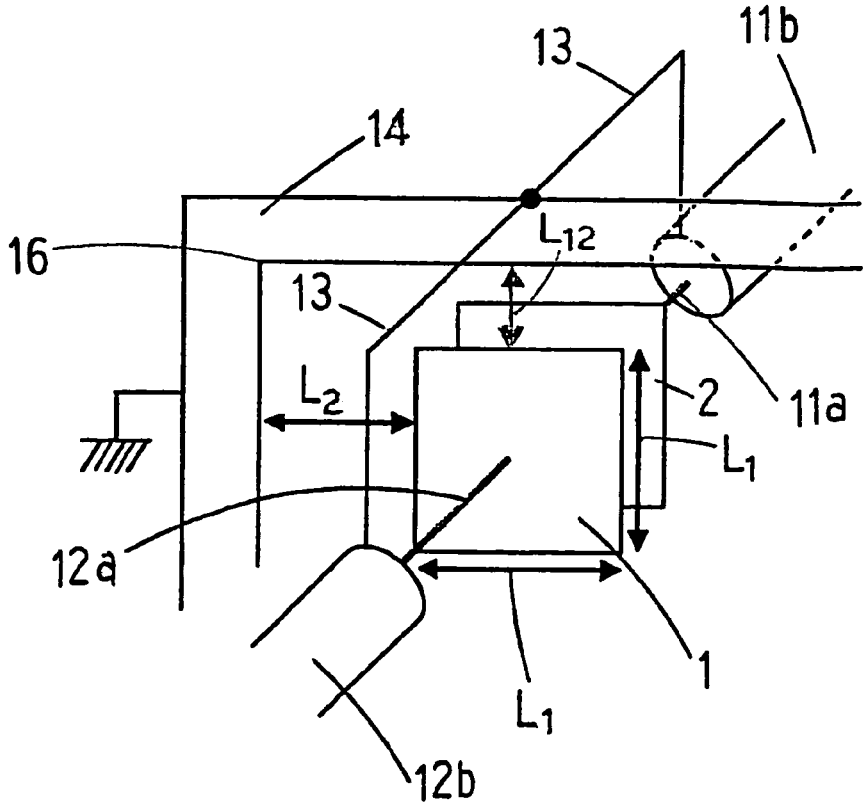
FIG. 10 is a structural view of pseudo testing equipment of the high frequency wave glass antenna for an automobile, used in Example 2.

Pseudo testing equipment of the high frequency wave glass antenna for an automobile, as shown in FIG. 10, was prepared. The testing equipment shown in FIG. 10 was one wherein an iron frame 14 was disposed as a pseudo car body and the frame 14 was mounted to the glass sheet of the testing equipment shown in FIG. 9. The frame 14 had an outermost peripheral portion formed in a square shape, and the frame had an L character shape in section perpendicular to one side of the square shape. The specifications and the like of the frame 14 are shown below:

| | |
|---|---|
| Square shape as shape of outermost peripheral portion of frame 14 | 610 × 610 mm |
| L character shaped portion of frame 14 | 25 × 25 mm |
| Thickness of iron plate of frame 14 | 2.8 mm |

-continued

| | |
|---|---|
| $L_1$ | 20 mm |
| Shortest distance between upper end portion of frame 14 and upper end portion of opposite electrode 1 in FIG. 10 | 20 mm |

Figure 15:
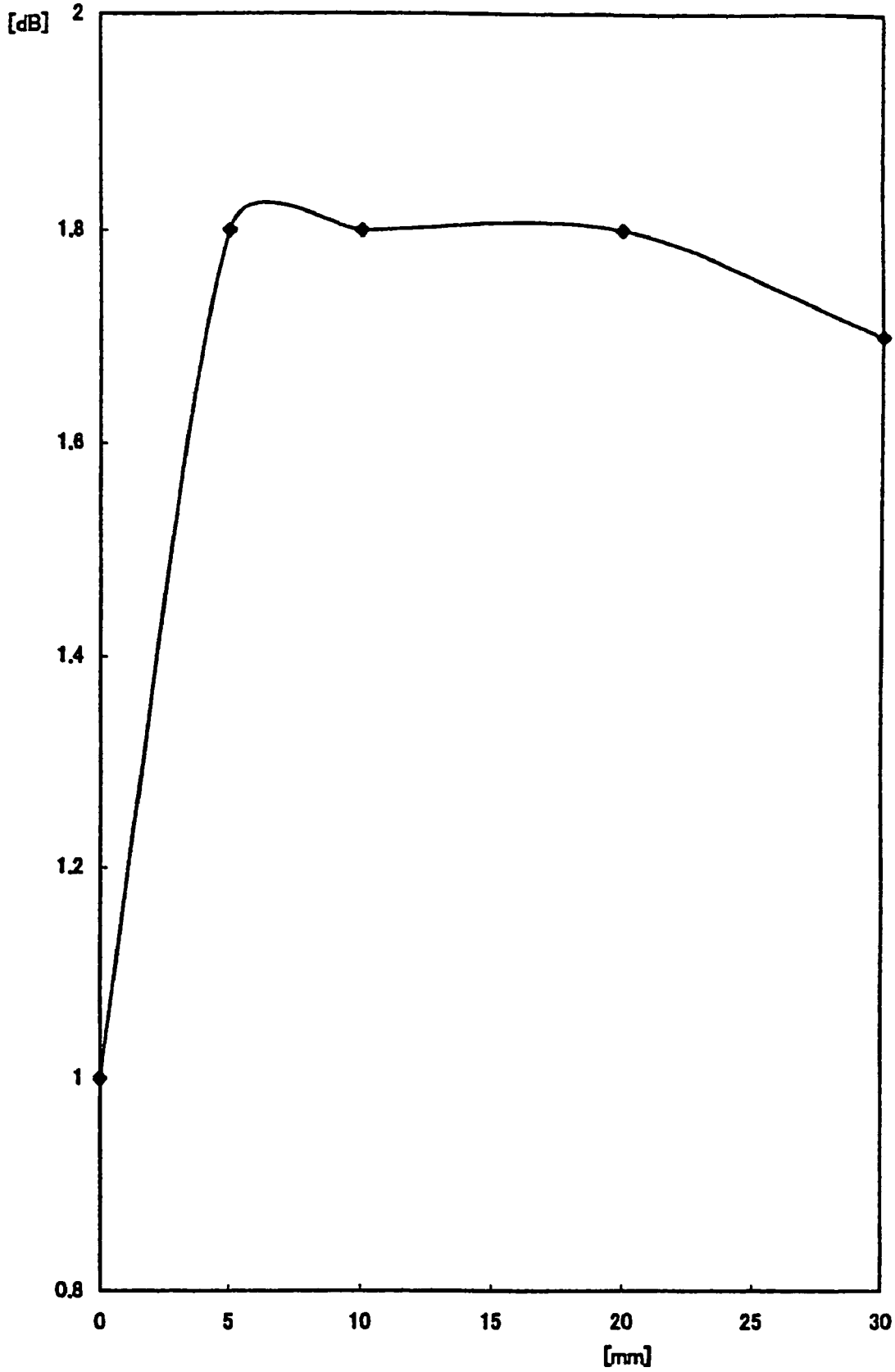
FIG. 15 is a characteristic view in Example 2, wherein the vertical axis represents a transmission efficiency and the horizontal axis represents $L_2$.

Measurement was made by modifying the shortest distance $L_2$ between the opposite electrode 1 and the frame 14 in the range of from 0.1 to 30.0 mm. In FIG. 15 is shown a characteristic diagram obtained by the measurement, wherein the vertical axis represents a transmission efficiency (dB) and the horizontal axis represents $L_2$.

Example 3

Testing equipment was prepared in the same specifications as that in Example 1 except that different glass sheets having a thickness of from 2.0 to 6.0 mm were used and that $L_1$ was fixed at 20 mm. In FIG. 16 is shown a characteristic view wherein the vertical axis represents a transmission efficiency (dB) and the horizontal axis represents the thickness of the glass sheets.

Example 4

Figure 11:
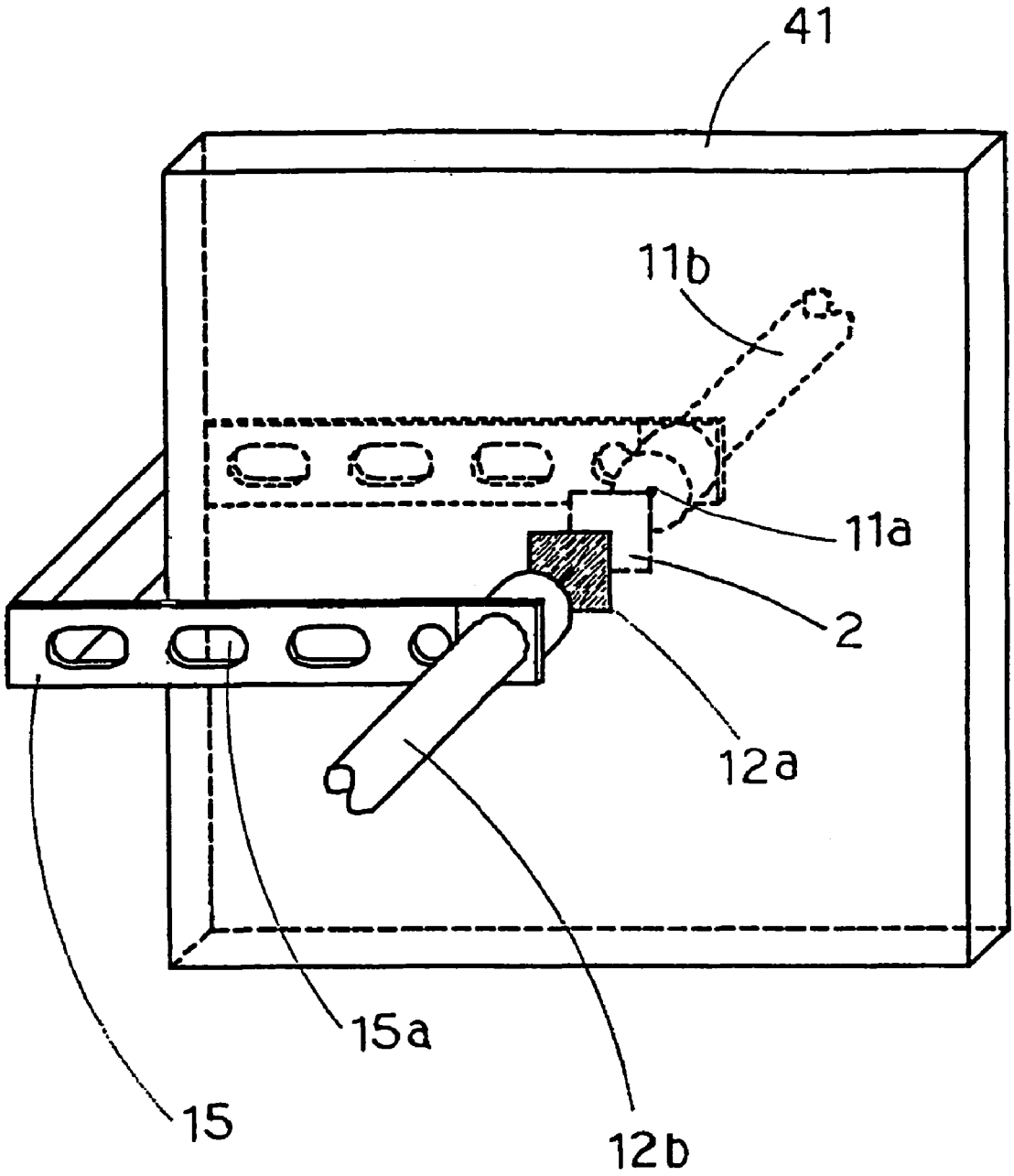
FIG. 11 is a structural view of pseudo testing equipment of the high frequency wave glass antenna for an automobile, used in Example 4.

Pseudo testing equipment of the high frequency wave glass antenna for an automobile, as shown in FIG. 11, was prepared. The testing equipment had the same specifications as that in Example 1 except for the specifications stated below. In FIG. 11, reference numeral 41 designates a glass sheet, reference numeral 15 designates an U-character shape iron fixture, and reference numeral 15*a* designates a hole formed in the fixture 15. In this testing equipment, the outer conductor 11*b* of a first coaxial cable and the outer conductor 12*b* of a second coaxial cable were connected by the fixture 15. The glass sheet 41 had dimensions of 600×600×2.0 mm, and the glass sheet 41 was made of soda lime. An antenna-conductor-side feeding electrode 2 and an opposite electrode 1 were disposed at the center of the glass sheet 41.

Figure 17:
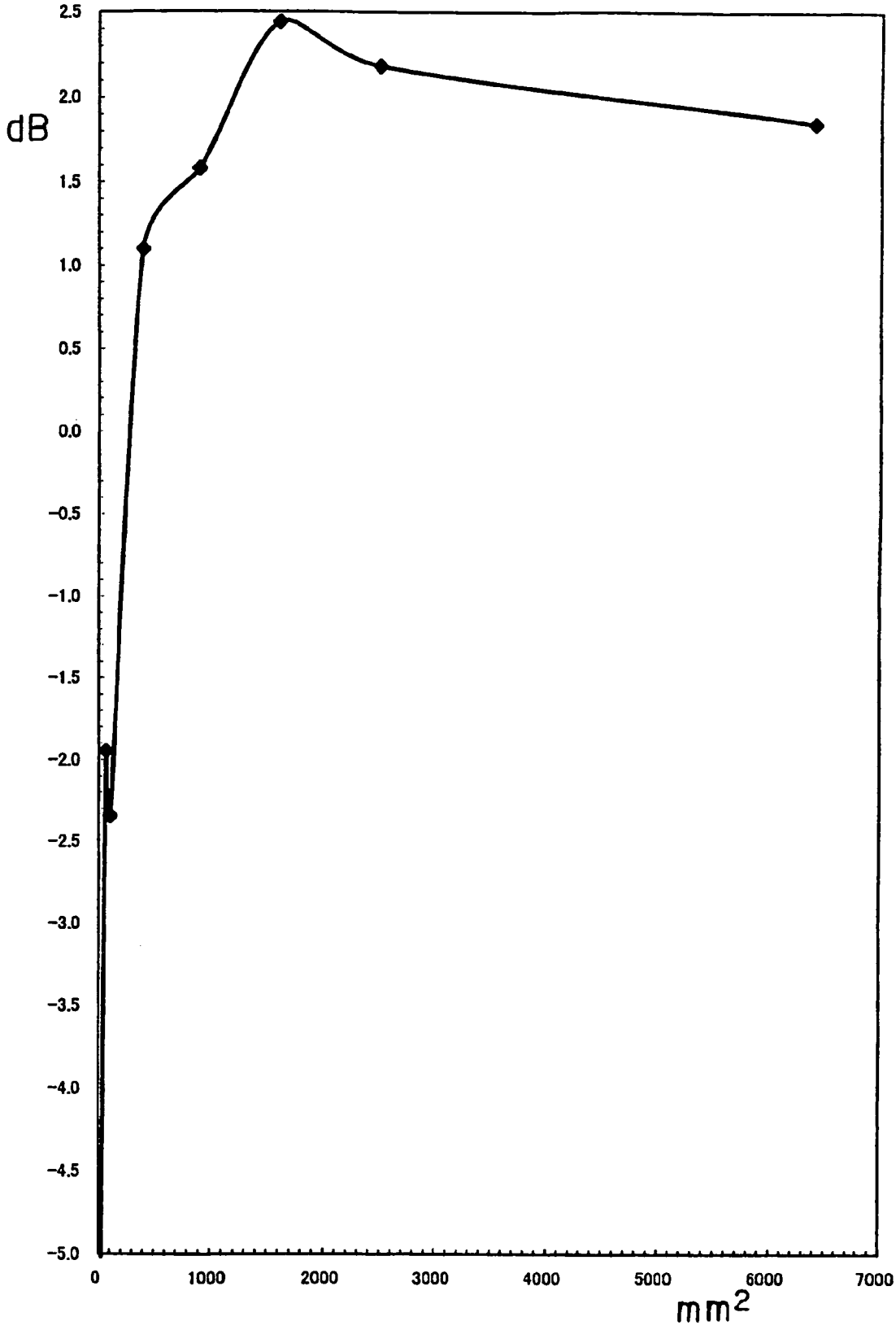
FIG. 17 is a characteristic view in Example 4, wherein the vertical axis represents a transmission efficiency and the horizontal axis represents the area of an antenna-conductor-side feeding electrode (which is the same as the area of an opposite electrode.
Figure 18:
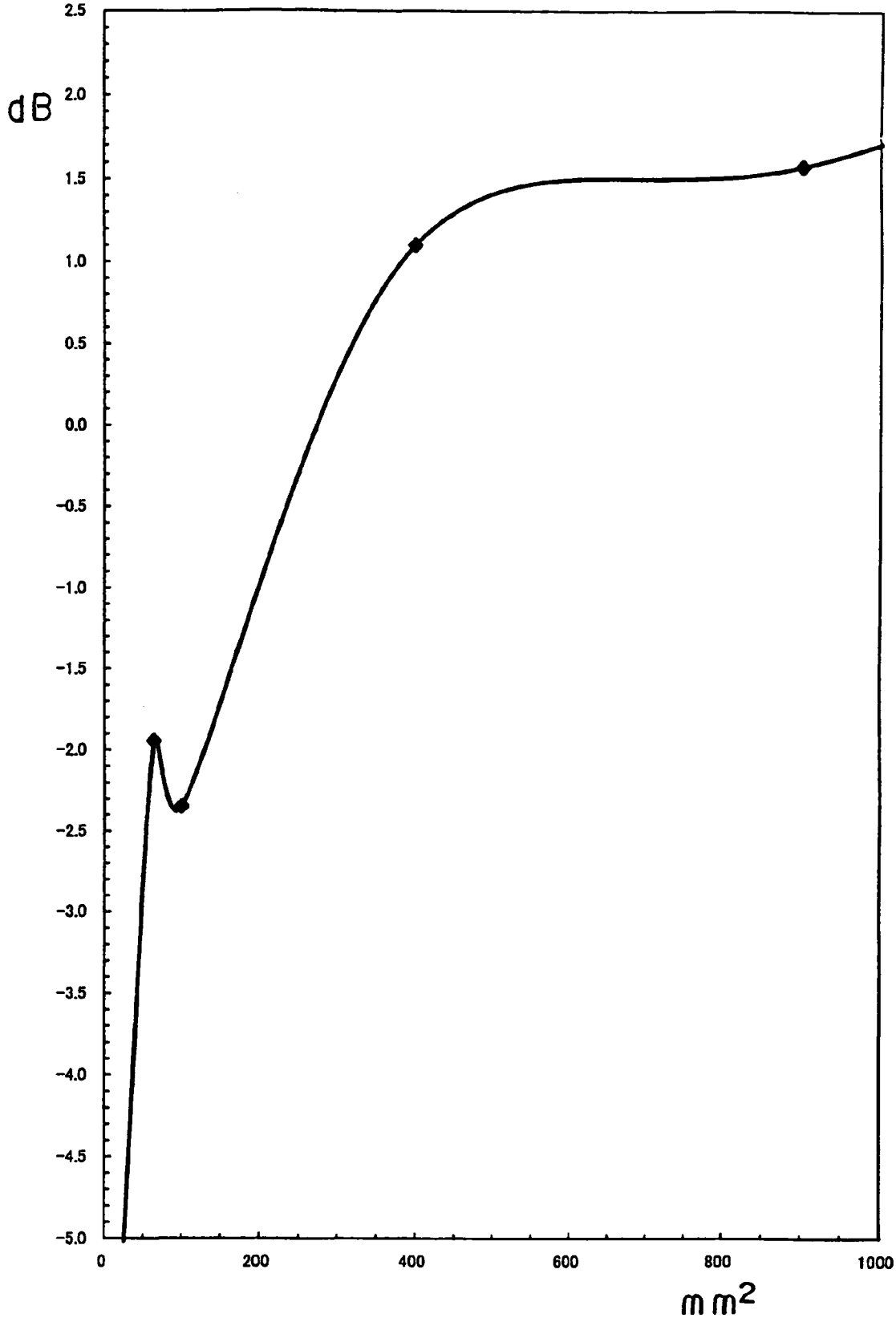
FIG. 18 is a characteristic view showing an enlarged portion of the characteristic curve shown in FIG. 17, which ranges from 0 to 1000 $mm^2$ in the horizontal axis.

The antenna-conductor-side feeding electrode 2 and the opposite electrode 1 were configured so as to have a square shape and the same dimensions as each other. Measurement was made by modifying the length of one side of the antenna-conductor-side feeding electrode 2 (the length of one side of the opposite electrode 1, which although not shown in FIG. 11, corresponds to $L_1$ shown in FIG. 9) in the range of from 5 to 80 mm. In FIG. 17 is shown a characteristic view wherein the vertical axis represents a transmission efficiency (dB) and the horizontal axis represents the area of the antenna-conductor-side feeding electrode 2 and the area of the opposite electrode 1. In FIG. 18 is shown an enlarged portion of the characteristic curve shown in FIG. 17, which ranges from 0 to 1,000 $mm^2$ in the horizontal axis.

Example 5

Figure 19:
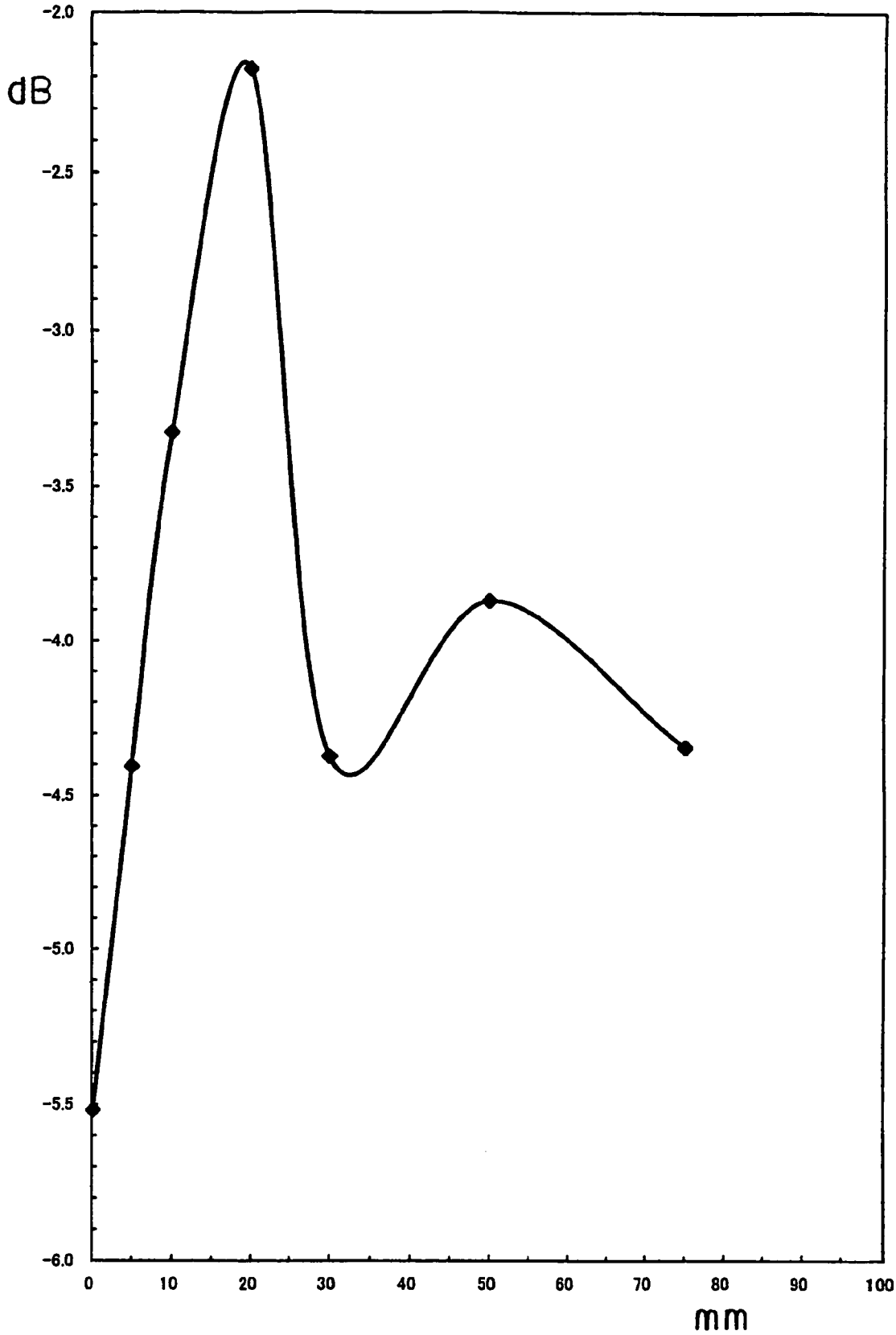
FIG. 19 is a characteristic view in Example 5, wherein the vertical axis represents a transmission efficiency (dB) and the horizontal axis represents $L_2$.

Measurement was made in the same method as that in Example 2 except that the lead wire 13 was modified to the metal fixture 15 and that some of the dimensions were modified stated below. Measurement was made by modifying the shortest distance $L_2$ between an opposite electrode 1 and a frame 14 in the range of from 0.1 to 75 mm. In FIG. 19 is shown a characteristic view wherein the vertical axis represents a transmission efficiency (dB) and the horizontal axis represent $L_2$.

| | |
|---|---|
| Glass sheet (length × width × thickness) | 600 × 600 × 2.0 mm |
| $L_1$ | 8 mm |
| Shortest distance $L_{12}$ between upper end portion of frame 14 and the upper end portion of opposite electrode 1 in FIG. 6 | 40 mm |

Example 6

Figure 12:
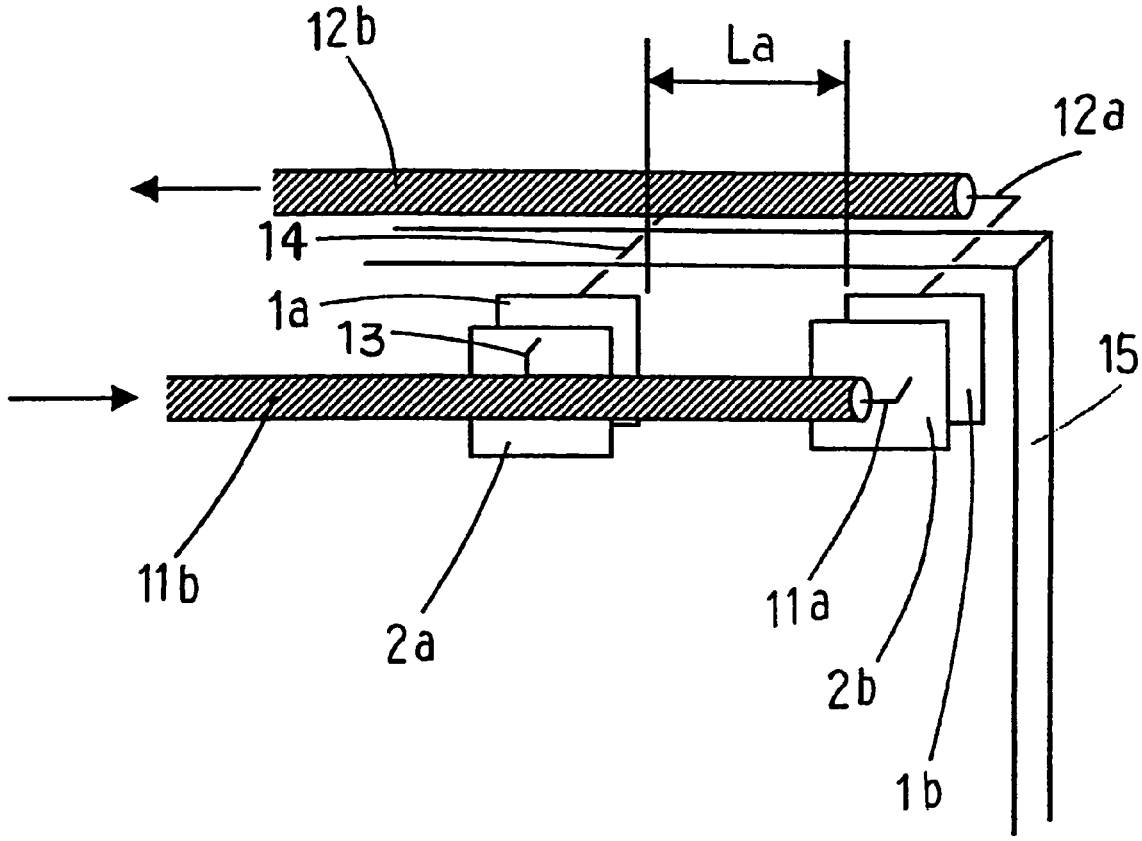
FIG. 12 is a structural view of pseudo testing equipment of the high frequency wave glass antenna for an automobile, used in Example 6.

Pseudo testing equipment of the high frequency wave glass antenna for an automobile, as shown in FIG. 12, was prepared. Each of a first antenna-conductor-side feeding electrode 2*a*, a second antenna-conductor-side feeding electrode 2*b*, a first opposite electrode 1*a* and a second opposite electrode 1*b* was prepared by affixing copper foil to a glass sheet 15 by a binder.

In FIG. 12, reference numeral 11*a* designates the inner conductor of a first coaxial cable, reference numeral 11*b* designates the outer conductor of the first coaxial cable, reference numeral 12*a* designates the inner conductor of a second coaxial cable, reference numeral 12*b* designates the outer conductor of the second coaxial cable, reference numeral 14 designates a lead wire connecting between the outer conductor 12*b* and the first opposite electrode 1*a*, and reference La designates the distance between the first opposite electrode 1*a* and the second opposite electrode 1*b* (the distance between the first antenna-conductor-side feeding electrode 2*a* and the second antenna-conductor-side feeding electrode 2*b*). The specifications and the like of the copper foil, the glass sheet 15 and the coaxial cables used in this example were shown below;

| | |
|---|---|
| Dimensions of first antenna-conductor-side feeding electrode 2a, second antenna-conductor-side feeding electrode 2b, first opposite electrode 1a and second opposite electrode 1b | 20 × 20 mm |
| Thickness of copper foil | 0.06 mm |
| Electrical resistivity of copper foil | $2.0 \times 10^{-6}$ Ωcm |
| Thickness of glass sheet | 3.5 mm |
| Impedance of coaxial cables | 50 Ω |

Bonding between the inner conductor 11*a* and the second antenna-conductor-side feeding electrode 2*b*, bonding between the inner conductor 12*b* and the second opposite electrode 1*b*, bonding between the outer conductor 11*b* and the lead wire 13, bonding between the outer conductor 11*b* and the lead wire 13, bonding between the outer conductor 12*b* and the lead wire 14, bonding between the first antenna-conductor-side feeding electrode 2*a* and the lead wire 13, and bonding between the first opposite electrode 1*a* and the lead wire 14 were made by soldering.

Figure 20:
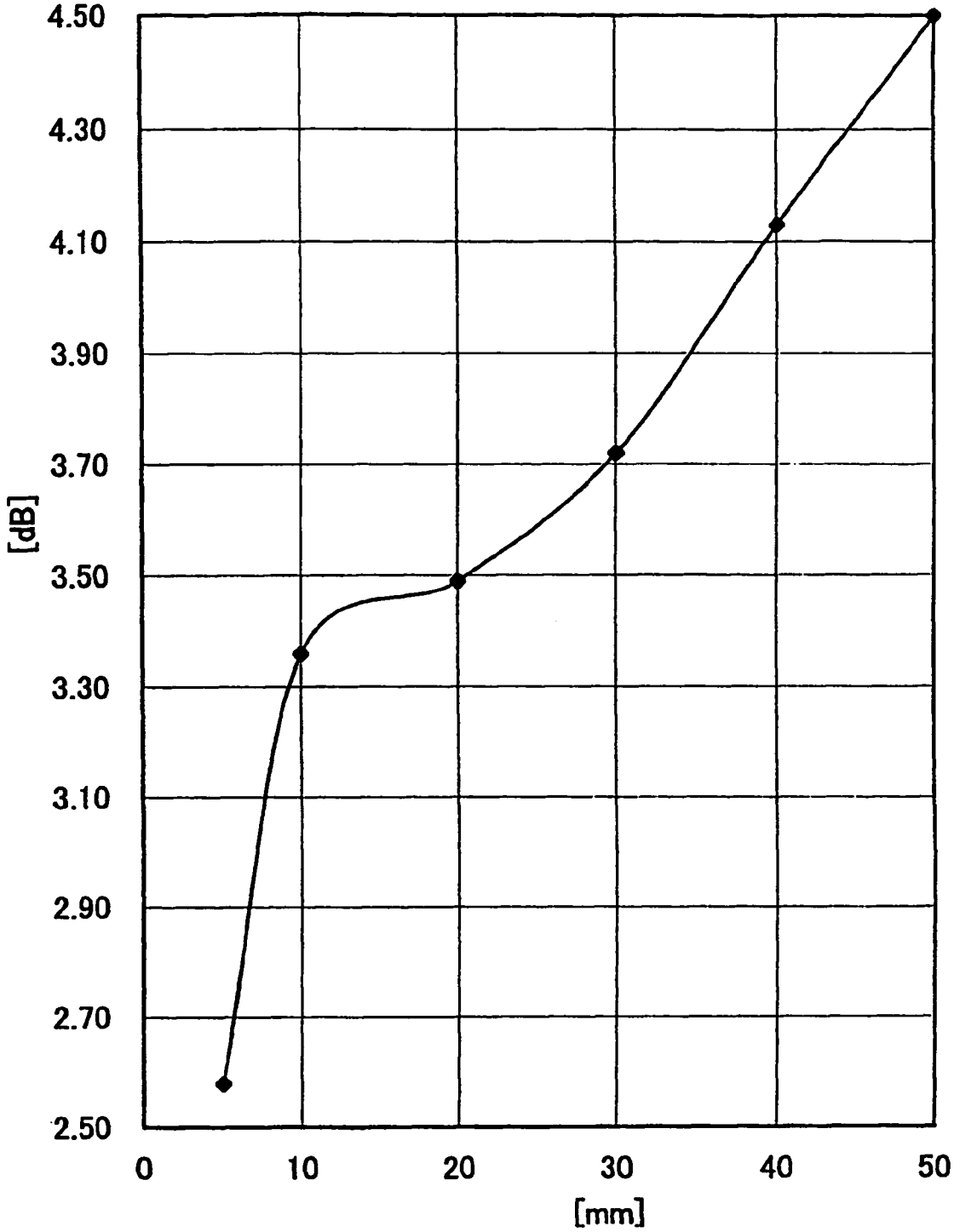
FIG. 20 is a characteristic view in Example 6, wherein the vertical axis represents a transmission efficiency and the horizontal axis represents a distance La.

A signal voltage having a voltage value was applied across the inner conductor 11*a* and the outer conductor 11*b*, and the signal voltage generated across the inner conductor 12*a* and the outer conductor 12*b* was measured, modifying the distance La in the range of from 5 to 50 mm. A characteristic curve obtained by the measurement is shown in FIG. 20 wherein the vertical axis represents a transmission efficiency (dB) and the horizontal axis represents the distance La.

Example 7

Figure 13:
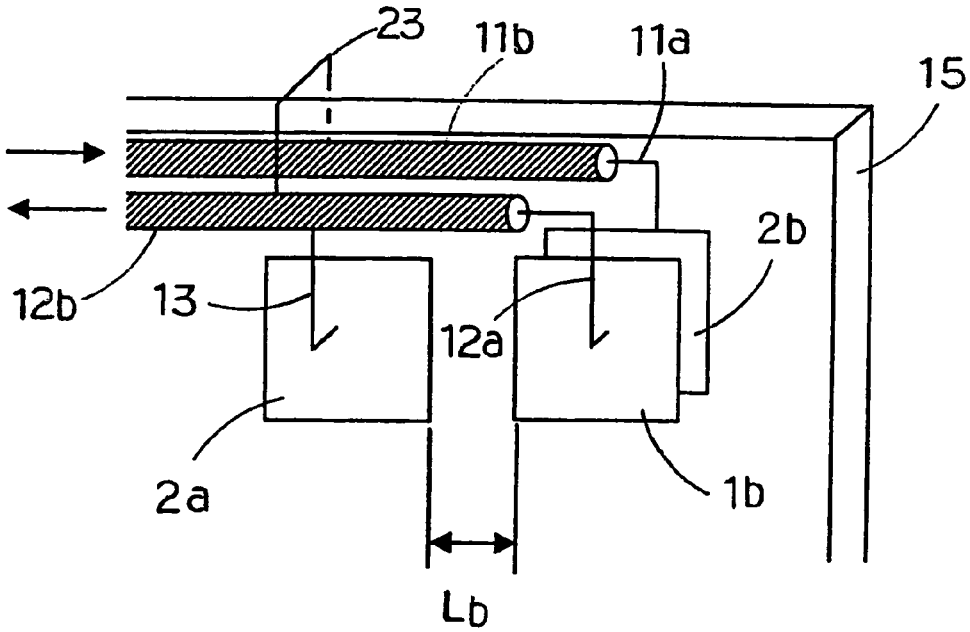
FIG. 13 is a structural view of pseudo testing equipment of the high frequency wave glass antenna for an automobile, used in Example 7.

Pseudo testing equipment shown in FIG. 13 was prepared by modifying the testing equipment used in Example 1 so that the glass sheet 15 had a first antenna-conductor-side feeding electrode 2*a*, a second antenna-conductor-side feeding electrode 2*b* and a second opposite electrode 1*b* disposed thereon. By using the testing equipment thus modified, the following test was conducted in connection with the second embodiment shown in FIG. 4. The outer conductor 11*b* and the outer conductor 12*b* was connected by a lead wire 23. Connection in FIG. 7 was soldering, which was the same as Example 1, and the unspecified specifications of Example 7 were the same as Example 1.

Figure 21:
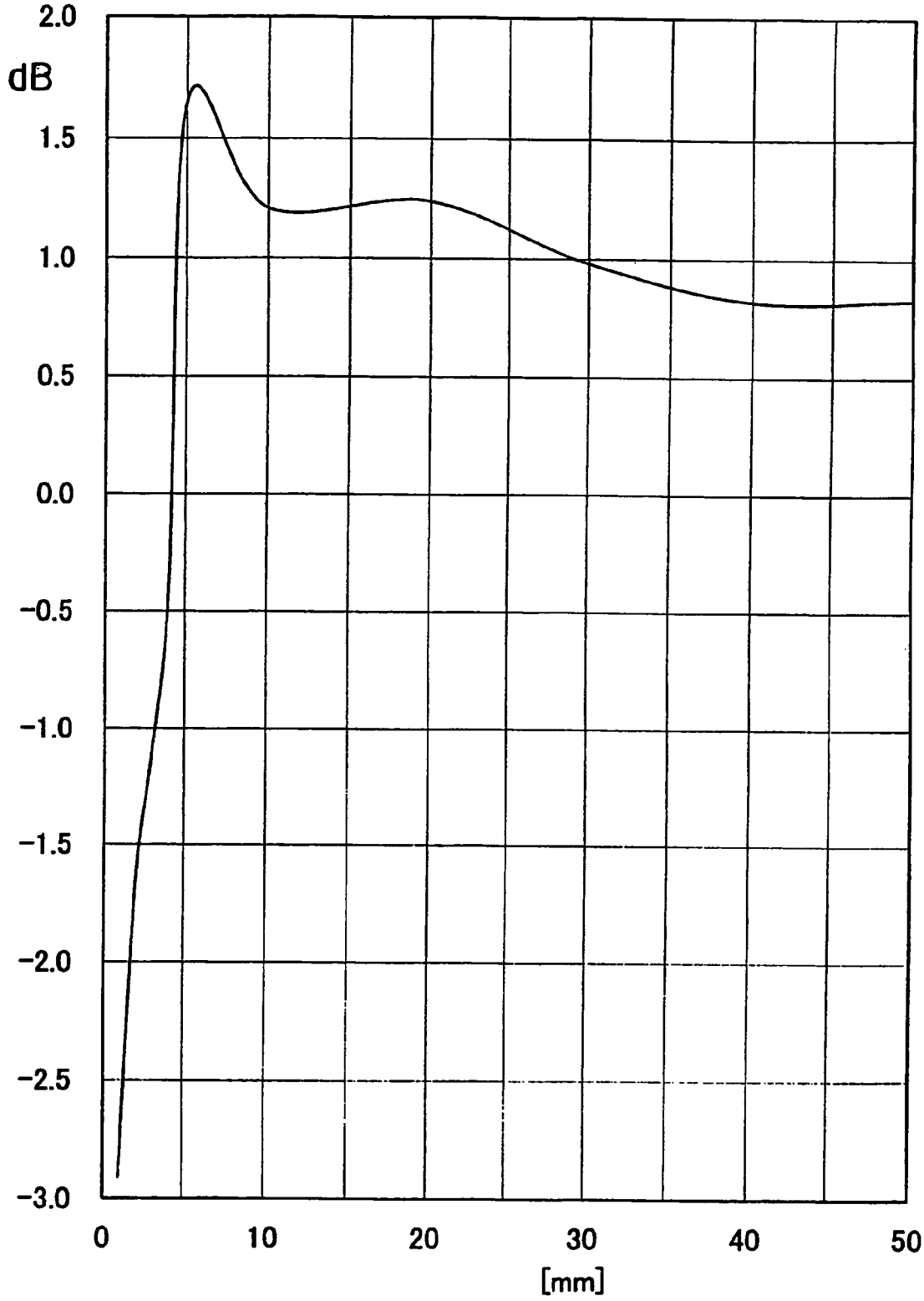
FIG. 21 is a characteristic view in Example 7, wherein the vertical axis represents a transmission efficiency and the horizontal axis represents a distance Lb.

A signal voltage having a voltage value was applied across the inner conductor 11*a* and the outer conductor 11*b*, and the signal voltage generated across the inner conductor 12*a* and the outer conductor 12*b* was measured, changing the distance Lb between the first antenna-conductor-side feeding electrode 2*a* and the second opposite electrode 1*b* to 1, 2, 3, 4, 5, 10, 20, 30, 40 and 50 mm. The characteristic view obtained by the measurement is shown in FIG. 21 wherein the vertical axis represents a transmission efficiency (dB) and the horizontal axis represents the distance Lb.

The present invention is applicable to a glass antenna for an automobile, which receives digital terrestrial television broadcasting and UHF television broadcasting.

The entire disclosures of Japanese Patent Application No. 2004-213103 filed on Jul. 21, 2004 and Japanese Patent Application No. 2004-268528 filed on Sep. 15, 2004 including specifications, claims, drawings and summaries are incorporated herein by reference in their entireties.

What is claimed is:

1. A high frequency wave glass antenna for an automobile, comprising:

two glass sheets, the glass sheets being bonded through a bonding layer to form a laminated glass sheet for an automobile;

an antenna conductor;

an antenna-conductor-side feeding electrode connected to the antenna conductor;

the antenna conductor and the antenna-conductor-side feeding electrode being disposed between the two glass sheets; and a receiver-side feeding electrode disposed at a position to confront the antenna-conductor-side feeding electrode and on a car-interior-side surface of the laminated glass;

wherein the antenna conductor is configured to receive at least one of a digital television broadcasting frequency band and a UHF television broadcasting frequency band;

wherein each of the antenna-conductor-side feeding electrode and the receiver-side feeding electrode has an area of from 49 to 2,500 $mm^2$; and wherein a distance between the antennas-conductor-side feeding electrode and the receiver-side feeding electrode is set so that both electrodes form at least one of electromagnetic coupling and capacitive coupling; and wherein a received signal excited in the antenna conductor is transmitted through the antenna-conductor-side feeding electrode to the receiver-side feeding electrode.

2. The glass antenna according to claim 1, wherein each of the antenna-conductor-side feeding electrode and the receiver-side feeding electrode has an area of from 140 to 2,500 $mm^2$.

3. The glass antenna according to claim 1, wherein the area of the antenna-conductor-side feeding electrode is from 0.5 to 1.5 times that of the receiver-side feeding electrode.

4. The glass antenna according to claim 1, wherein the laminated glass sheet comprises a car-interior-side glass sheet and a car-exterior-side glass sheet; and wherein the antenna-conductor-side feeding electrode and the receiver-side feeding electrode have the car-interior-side glass sheet interposed therebetween.

5. The glass antenna according to claim 1, wherein the laminated glass sheet comprises a car-interior-side glass sheet and a car-exterior-side glass sheet; and wherein the antenna-conductor-side feeding electrode and the receiver-side feeding electrode have the car-interior-side glass sheet and an interlayer film interposed therebetween, the interlayer film comprising a synthetic resin film.

6. The glass antenna according to claim 1, wherein the laminated glass sheet comprises a car-interior-side glass sheet, a car-exterior-side glass sheet and an interlayer film, the interlayer film being interposed between the car-interior-side glass sheet and the car-exterior-side glass sheet, the interlayer film comprising a synthetic resin film; and wherein the antenna-conductor-side feeding electrode is disposed on a surface of the car-interior-side glass sheet close to the interlayer film or on a surface of the car-exterior-side glass sheet close to the interlayer film.

7. The glass antenna according to claim 1, wherein the laminated glass sheet has a shielding layer disposed on the car-interior-side surface; and wherein the receiver-side feeding electrode is disposed on the shielding layer.

8. The glass antenna according to claim 1, wherein at least one of the antenna-conductor-side feeding electrode and the receiver-side feeding electrode is formed in a square shape, a substantially square shape, a circular shape, a substantially circular shape, an oval shape or a substantially oval shape.

9. The glass antenna according to claim 1, wherein a received carrier wave contains a frequency of from 470 to 704 MHz.

10. The glass antenna according to claim 1, wherein a received carrier wave contains a frequency of from 473 to 767 MHz.

11. The glass antenna according to claim 1, wherein a received carrier wave contains a frequency of from 450 to 750 MHz.

12. The glass antenna according to claim 1, wherein a received carrier wave contains a frequency of from 698 to 806 MHz.

13. A laminated glass sheet of an automobile, including two glass sheets, the glass sheets being bonded through a bonding layer to form the laminated glass sheet for an automobile, and the antenna conductor, and the antenna-conductor-side feeding electrode and the receiver-side feeding electrode defined in claim 1.

14. A high frequency wave glass antenna for an automobile, comprising:

two glass sheets, the glass sheets being bonded through a bonding layer to form a laminated glass sheet for an automobile;

an antenna conductor;

an antenna-conductor-side feeding electrode connected to the antenna conductor;

the antenna conductor and the antenna-conductor-side feeding electrode being disposed between the two glass sheets; and a receiver-side feeding electrode disposed at a position to confront the antenna-conductor-side feeding electrode and on a car-interior-side surface of the laminated glass;

wherein the antenna conductor is configured to receive at least one of a digital television broadcasting frequency band and a UHF television broadcasting frequency band;

wherein each of the antenna-conductor-side feeding electrode and the receiver-side feeding electrode has an area of from 49 to 2,500 $mm^2$;

wherein a shortest distance between the receiver-side feeding electrode and an edge of an opening formed in a car body is from 1.8 to 50.0 mm;

wherein a distance between the antenna-conductor-side feeding electrode and the receiver-side feeding electrode is set so that both electrodes form at least one of electromagnetic coupling and capacitive coupling; and wherein a received signal excited in the antenna conductor is transmitted through the antenna-conductor-side feeding electrode to the receiver-side feeding electrode.

15. The glass antenna according to claim 14, wherein when each of the antenna-conductor-side feeding electrode and the receiver-side feeding electrode has an area of from 49 to 144 $mm^2$, the shortest distance between the receiver-side feeding electrode and the edge of the opening formed in the car body is from 1.8 to 28 mm.

16. The glass antenna according to claim 14, wherein a received carrier wave contains a frequency of from 473 to 767 MHz.

17. The glass antenna according to claim 14, wherein a received carrier wave contains a frequency of from 698 to 806 MHz.

18. A high frequency wave glass antenna for an automobile, comprising:

two glass sheets, the glass sheets being bonded through a bonding layer to form a laminated glass sheet for an automobile;

an antenna conductor;

an antenna-conductor-side feeding electrode connected to the antenna conductor;

the antenna conductor and the antenna-conductor-side feeding electrode being disposed between the two glass sheets; and a receiver-side feeding electrode disposed at a position to confront the antenna-conductor-side feeding electrode and on a car-interior-side surface of the laminated glass;

wherein each of the antenna-conductor-side feeding electrode and the receiver-side feeding electrode has an area of from 49 to 2,500 $mm^2$;

wherein a distance between the antenna-conductor-side feeding electrode and the receiver-side feeding electrode is from 1.50 to 6.00 mm; and wherein the distance between the antenna-conductor-side feeding electrode and the receiver-side feeding electrode is related to a transmission efficiency of a received signal to be transmitted from the antenna-conductor-side feeding electrode to the receiver-side feeding electrode, such that the distance is determined so as to prevent the transmission efficiency from being brought close to a minimum value when the transmission efficiency changes, having the minimum value and a maximum value according to the distance.

19. The glass antenna according to claim 18, wherein the distance between the antenna-conductor-side feeding electrode and the receiver-side feeding electrode is determined so as to satisfy the following formula:

$$\text{maximum value} \geqq \text{transmission efficiency} \geqq (1/3)(2\times\text{maximum value}+\text{minimum value}).$$

20. The glass antenna according to claim 18, wherein the distance between the antenna-conductor-side feeding electrode and the receiver-side feeding electrode is from 1.50 to 2.72 mm or from 2.87 to 6.00 mm.

21. A laminated glass sheet of an automobile, including two glass sheets, the glass sheets being bonded through a bonding layer to form the laminated glass sheet for an automobile, and the antenna conductor, the antenna-conductor-side feeding electrode and the receiver-side feeding electrode defined in claim 6.

22. A high frequency wave glass antenna for an automobile, comprising:

two glass sheets, the glass sheets being bonded through a bonding layer to form a laminated glass sheet for an automobile;

a first antenna conductor;

a first antenna-conductor-side feeding electrode connected to the first antenna conductor;

the first antenna conductor and the first antenna-conductor-side feeding electrode being disposed between the two glass sheets;

a second antenna conductor;

a second antenna-conductor-side feeding electrode connected to the second antenna conductor;

the second antenna conductor and the second antenna-conductor-side feeding electrode being disposed between the two glass sheets;

a first receiver-side feeding electrode disposed at a position to confront the first antenna-conductor-side feeding electrode and on a car-interior-side surface of the laminated glass; and a second receiver-side feeding electrode disposed at a position to confront the second antenna-conductor-side feeding electrode and on the car-interior-side surface of the laminated glass;

wherein a distance between the first antenna-conductor-side feeding electrode and the second antenna-conductor-side feeding electrode is from 6 to 100 mm.

23. The glass antenna according to claim 22, wherein each of the first antenna-conductor-side feeding electrode, the second antenna-conductor-side feeding electrode, the first receiver-side feeding electrode and the second receiver-side feeding electrode has an area of from 49 to 2,500 $mm^2$.

24. The glass antenna according to claim 22, wherein the laminated glass sheet has a shielding layer disposed on the car-interior-side surface; and wherein at least one of the first receiver-side feeding electrode and the second receiver-side feeding electrode is disposed on the shielding layer.

25. The glass antenna according to claim 22, wherein at least one selected among the first antenna-conductor-side feeding electrode, the second antenna-conductor-side feeding electrode, the first receiver-side feeding electrode and the second receiver-side feeding electrode is formed in a shape selected among a square shape, a substantially square shape, a circular shape, a substantially circular shape, an oval shape and a substantially oval shape.

26. The glass antenna according to claim 22, wherein a received carrier wave contains a frequency of from 473 to 767 MHz.

27. The glass antenna according to claim 22, wherein a received carrier wave contains a frequency of from 698 to 806 MHz.

28. A high frequency wave glass antenna for an automobile, comprising:

two glass sheets, the glass sheets being bonded through a bonding layer to form a laminated glass sheet for an automobile;

a first antenna conductor;

a first antenna-conductor-side feeding electrode connected to the first antenna conductor;

the first antenna conductor and the first antenna-conductor-side feeding electrode being disposed on a car-interior-side surface of the laminated glass sheet;

a second antenna conductor;

a second antenna-conductor-side feeding electrode connected to the second antenna conductor;

the second antenna conductor and the second antenna-conductor-side feeding electrode being disposed between the two glass sheets;

a receiver-side feeding electrode disposed at a position to confront the second antenna-conductor-side feeding electrode and on the car-interior-side surface of the laminated glass;

wherein a distance between the first antenna-conductor-side feeding electrode and the receiver-side feeding electrode is from 2.5 to 100 mm.

29. The glass antenna according to claim 28, wherein the distance between the first antenna-conductor-side feeding electrode and the receiver-side feeding electrode is from 4 to 100 mm.

30. The glass antenna according to claim 28, wherein each of the first antenna-conductor-side feeding electrode, the second antenna-conductor-side feeding electrode and the receiver-side feeding electrode has an area of from 49 to 2,500 $mm^2$.

31. The glass antenna according to claim 28, wherein the laminated glass sheet has a shielding layer disposed on the car-interior-side surface; and wherein at least one selected among the first antenna conductor, the first antenna-conductor-side feeding electrode and the receiver-side feeding electrode is disposed on the shielding layer.

32. The glass antenna according to claim 28, wherein at least one selected among the first antenna-conductor-side feeding electrode, the second antenna-conductor-side feeding electrode and the receiver-side feeding electrode is formed in a shape selected among a square shape, a substantially square shape, a circular shape, a substantially circular shape, an oval shape and a substantially oval shape.

33. The glass antenna according to claim 28, wherein a received carrier wave contains a frequency of from 473 to 767 MHz.

34. The glass antenna according to claim 28, wherein a received carrier wave contains a frequency of from 698 to 806 MHz.

* * * * *